US008927184B2

(12) United States Patent
Sekiya et al.

(10) Patent No.: US 8,927,184 B2
(45) Date of Patent: Jan. 6, 2015

(54) METHOD OF PRODUCING ELECTROPHOTOGRAPHIC PHOTOSENSITIVE MEMBER

(75) Inventors: Michiyo Sekiya, Atami (JP); Kunihiko Sekido, Suntou-gun (JP); Akihiro Maruyama, Mishima (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 13/989,375

(22) PCT Filed: Nov. 10, 2011

(86) PCT No.: PCT/JP2011/076587
§ 371 (c)(1),
(2), (4) Date: May 23, 2013

(87) PCT Pub. No.: WO2012/070472
PCT Pub. Date: May 31, 2012

(65) Prior Publication Data

US 2013/0244172 A1 Sep. 19, 2013

(30) Foreign Application Priority Data

Nov. 26, 2010 (JP) ..... 2010-264129
Sep. 21, 2011 (JP) ..... 2011-206101

(51) Int. Cl.
*G03G 5/04* (2006.01)
*G03G 15/00* (2006.01)
*G03G 5/05* (2006.01)
*G03G 5/06* (2006.01)

(52) U.S. Cl.
CPC ..... *G03G 15/00* (2013.01); *G03G 5/0525* (2013.01); *G03G 5/0535* (2013.01); *G03G 5/0546* (2013.01); *G03G 5/0589* (2013.01); *G03G 5/0596* (2013.01); *G03G 5/06* (2013.01)
USPC ..... 430/58.05; 430/59.6

(58) Field of Classification Search
CPC ... G03G 5/047; G03G 5/0614; G03G 5/0514; G03G 5/0564; G03G 5/0592; G03G 5/142
USPC ..... 430/58.05, 59.6
See application file for complete search history.

(56) References Cited

U.S. PATENT DOCUMENTS 4,442,193 A 4/1984 Chen
4,562,132 A 12/1985 Ong
(Continued)

FOREIGN PATENT DOCUMENTS

CN 1412624 A 4/2003
CN 101013276 A 8/2007
(Continued)

OTHER PUBLICATIONS

Yamada. Masaki, et al., "Synthesis and properties of Diamino-Substituted Dipyrido [3,2-a: 2',3'-c]phenazine", Bull. Chem. Soc. Jpn., vol. 65, No. 4, pp. 1006-1011 (1992) or Callahan, Ronald et al., "Syntheses of Phencyclone Analogues, Applications for NMR Studies of Hindered Rotations and Magnetic Anistropy in Crowded Diels-Alder Adducts", Chem. Educator, No. 6, pp. 227-234 (2001).

(Continued)

*Primary Examiner* — Hoa V Le
(74) *Attorney, Agent, or Firm* — Canon U.S.A., Inc. IP Division

(57) ABSTRACT

The present invention provides a method of producing an electrophotographic photosensitive member using a dispersion solution that shows high liquid stability in long-period storage and hardly causes aggregation of charge-transporting pigment particles during drying a coating. The method of producing an electrophotographic photosensitive member having a charge-transporting layer comprises a step of forming a coating film by applying a dispersion solution comprising polyolefin polymer particles and charge-transporting pigment particles as dispersoids and comprising a dispersion medium, and then forming the charge-transporting layer by heating the coating film and melting the polyolefin polymer particles, wherein the particles consisting of the polyolefin polymer particles and the charge-transporting pigment particles in the dispersion solution have a number average particle diameter of 50 nm or more and 300 nm or less and a degree of dispersion (standard deviation/number average particle diameter) of 1.0 or less.

5 Claims, 1 Drawing Sheet

(56) References Cited

U.S. PATENT DOCUMENTS

| | | | | |
|---|---|---|---|---|
| 4,992,349 | A | 2/1991 | Chen | |
| 5,468,583 | A | 11/1995 | Gruenbaum | |
| 5,965,063 | A * | 10/1999 | Agata et al. | 252/500 |
| 2003/0118927 | A1 * | 6/2003 | Nakamura et al. | 430/65 |
| 2007/0059619 | A1 * | 3/2007 | Shimoyama et al. | 430/58.7 |

FOREIGN PATENT DOCUMENTS

| | | | |
|---|---|---|---|
| JP | 1206349 | A | 8/1989 |
| JP | 5279582 | A | 10/1993 |
| JP | 7070038 | A | 3/1995 |
| JP | 7089962 | A | 4/1995 |
| JP | 10115945 | A | 5/1998 |
| JP | 10161326 | A | 6/1998 |
| JP | 2003105145 | A | 4/2003 |
| JP | 2003147028 | A | 5/2003 |
| JP | 2004093791 | A | 3/2004 |
| JP | 2009288621 | A | 12/2009 |
| JP | 2009288623 | A | 12/2009 |
| JP | 2011095665 | A | 5/2011 |

OTHER PUBLICATIONS

Bolitt, Veronique, et al., "A Convenient Synthesis of Pyrido[3,4-g]isoquinoline via ortho-Directed Metallation/Dimerization", Synthesis, vol. 5, pp. 388-389 (1988).

Okada, Hideki, et al., "Synthesis and Properties of a Novel Electron Transporting Compound, 3 , 3 '-dialkyl-4,4'-bisnaphthylquinone (DBNQ)", The Proceedings of PPCI Japan Hard Copy, '98, pp. 207-210 (1998).

* cited by examiner

METHOD OF PRODUCING ELECTROPHOTOGRAPHIC PHOTOSENSITIVE MEMBER

TECHNICAL FIELD

The present invention relates to a method of producing an electrophotographic photosensitive member.

BACKGROUND ART

Electrophotographic photosensitive members generally include supports and photosensitive layers disposed on the supports. Some of the photosensitive layers are a lamination type including a charge-generating layer containing a charge-generating material and a charge-transporting layer containing a charge-transporting material.

In general, the charge-transporting layer is formed as a uniform layer by a method where a coating film is formed by application of a coating liquid prepared by dissolving a low-molecular-weight charge-transporting compound serving as a charge-transporting material and a resin (binder resin) serving as a binder material in a solvent and drying the resulting coating.

Meanwhile, PTLs 1 and 2 disclose techniques of providing ununiform charge-transporting layers in order to obtain high-gamma electrophotographic photosensitive members, reduce residual potentials, and maintain high image qualities for a long time. In each method of forming a ununiform charge-transporting layer disclosed in PTLs 1 and 2, a coating film is formed by application of a dispersion solution prepared by dispersing charge-transporting pigment particles in a solution (polymer solution) in which a polymer is dissolved in a solvent and drying the resulting coating.

Unfortunately, in the case of using the dispersion solution prepared by dispersing charge-transporting pigment particles in a polymer solution, insufficient dispersion treatment of the charge-transporting pigment particles, low solution stability of the prepared dispersion solution, or occurrence of aggregation of the charge-transporting pigment particles during drying of the coating may be caused. Consequently, a deviation in charge transfer in the charge-transporting layer, an insufficient sensitivity of the electrophotographic photosensitive member, or an insufficient reduction of the residual potential may occur.

PTL 3 discloses a method of forming an intermediate layer of an electrophotographic photosensitive member using a dispersion solution prepared by dispersing charge-transporting pigment particles (electron-transporting pigment particles) in a polymer emulsion.

CITATION LIST

Patent Literature

PTL 1 Japanese Patent Laid-Open No. 10-161326
PTL 2 Japanese Patent Laid-Open No. 10-115945
PTL 3 Japanese Patent Laid-Open No. 2009-288621

SUMMARY OF INVENTION

Technical Problem

The dispersion solution disclosed in PTL 3 initially shows satisfactory liquid stability, but the liquid stability in the case of storing the dispersion solution for a long time and inhibition of aggregation of the charge-transporting pigment particles during drying of a coating are insufficient.

The present invention provides a method of producing an electrophotographic photosensitive member using a dispersion solution that shows high liquid stability in long-period storage and hardly causes aggregation of charge-transporting pigment particles during drying of a coating.

Solution to Problem

The present invention relates to a method of producing an electrophotographic photosensitive member comprising a charge-transporting layer, and the method includes a step of forming a coating film by applying a dispersion solution comprising polyolefin polymer particles and charge-transporting pigment particles as dispersoids and comprising a dispersion medium, and then forming the charge-transporting layer by heating the coating film and melting the polyolefin polymer particles, wherein, the particles consisting of the polyolefin polymer particles and the charge-transporting pigment particles in the dispersion solution have a number average particle diameter of 50 nm or more and 300 nm or less and a degree of dispersion (standard deviation/number average particle diameter) of 1.0 or less.

Advantageous Effects of Invention

The present invention can provide a method of producing an electrophotographic photosensitive member using a dispersion solution that shows high liquid stability in long-period storage and hardly causes aggregation of charge-transporting pigment particles during drying a coating.

DESCRIPTION OF EMBODIMENTS

Figure 1:
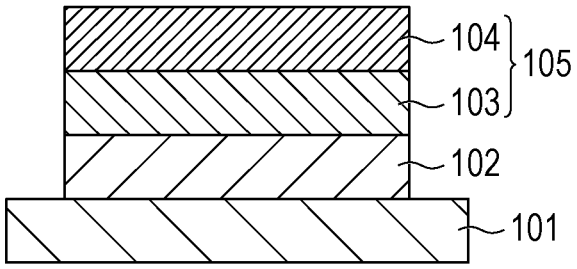
FIG. 1 is a diagram illustrating an example of the layer structure of an electrophotographic photosensitive member.

The dispersion solution, according to the present invention, containing polyolefin polymer particles and charge-transporting pigment particles, as dispersoids, and a dispersion medium is a solution in which both the polyolefin polymer particles and the charge-transporting pigment particles are dispersed in the dispersion medium.

The charge-transporting pigment particles that are used in the present invention are of a charge-transporting compound insoluble in the dispersion medium of the dispersion solution. For example, in the case that the dispersion medium of the dispersion solution is water, a charge-transporting compound insoluble in water is the charge-transporting pigment particles that are used in the present invention.

Examples of the charge-transporting compound include hydrazine compounds, triarylamine compounds, stilbene compounds, quinone compounds, imide compounds, benzimidazole compounds, cyclopentadienylidene compounds, and azo compounds.

The charge-transporting compounds will be described below. In the present invention, charge-transporting compounds represented by the following Formulae (1) to (9) and high molecular weighted charge-transporting compounds thereof can be particularly used. The charge-transporting compounds represented by the following Formulae (1) to (9) are electron-transporting compounds.

Examples of the imide compound include compounds having a cyclic imide structure. The imide compound may have a condensed aromatic ring structure. Specific examples thereof include compounds represented by the following Formula (1):

(1)

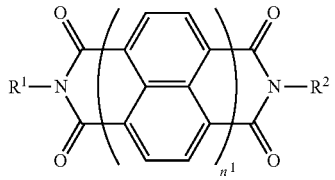

In Formula (1), $R^1$ and $R^2$ each independently represents a substituted or unsubstituted alkyl, phenyl, or pyridyl group, the substituent of which is an alkyl group, a haloalkyl group, a hydroxyalkyl group, a halogen atom, a hydroxy group, a carboxy group, an alkoxy group, a cyano group, a nitro group, a phenyl group, or a phenyldiazenyl group; and $n^2$ is 1 or 2.

Examples of the benzimidazole compound include compounds having a benzimidazole ring structure. The benzimidazole compound may have a condensed aromatic ring structure. Specific examples thereof include compounds represented by any of the following Formulae (2) to (4):

(2)

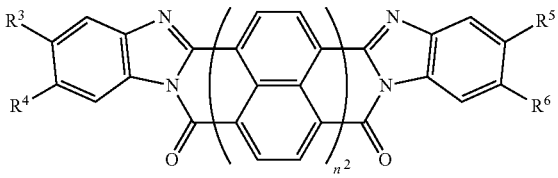

In Formula (2), $R^3$ to $R^6$ each independently represents a hydrogen atom, a halogen atom, or an alkyl group; and $n^2$ is 1 or 2.

(3)

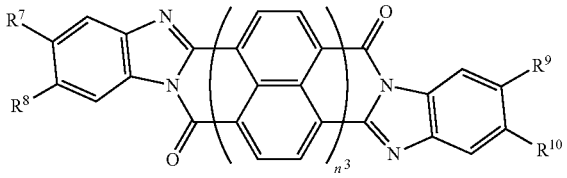

In Formula (3), $R^7$ to $R^{13}$ each independently represents a hydrogen atom, a halogen atom, or an alkyl group; and $n^3$ is 1 or 2.

(4)

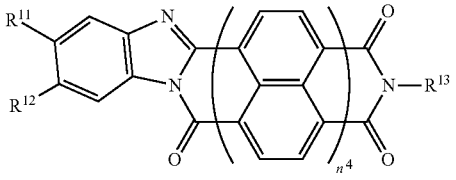

In Formula (4), $R^7$ and $R^{12}$ each independently represents a hydrogen atom, a halogen atom, a nitro group, or an alkyl group; $R^{13}$ represents a substituted or unsubstituted alkyl, phenyl, or naphthyl group, the substituent of which is an alkyl group, a haloalkyl group, a hydroxyalkyl group, a halogen atom, a hydroxy group, a carboxy group, a nitro group, or a cyano group; and $n^4$ is 1 or 2.

Examples of the quinone compound include compounds having a para-quinoid structure or an ortho-quinoid structure. The quinone compound may have a condensed aromatic ring structure or a structure where quinoid structures are connected to each other. Specific examples thereof include compounds represented by any of the following Formulae (5) to (7):

(5)

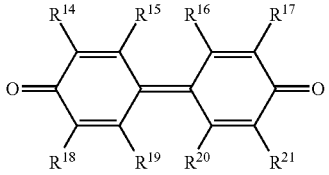

In Formula (5), $R^{14}$ to $R^{21}$ each independently represents a hydrogen atom or an alkyl group, or any of $R^{14}$ to $R^{21}$ may form a divalent group represented by —CH═CH—CH═CH— through binding with an adjacent substituent.

(6)

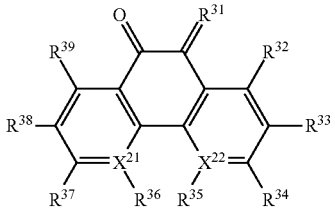

In Formula (6), $R^{31}$ represents an oxygen atom or dicyanomethylene group; $R^{32}$ to $R^{39}$ each independently represents a hydrogen atom, a halogen atom, a nitro group, or a substituted or unsubstituted alkyl or phenyl group, the substituent of which is an alkyl group, a haloalkyl group, a halogen atom, a hydroxy group, a carboxy group, a nitro group, or a cyano group; and $X^{21}$ and $X^{22}$ each independently represents a carbon atom or a nitrogen atom, wherein when $X^{21}$ is a nitrogen atom, $R^{36}$ does not exist, and when $X^{22}$ is a nitrogen atom, $R^{35}$ does not exist.

(7)

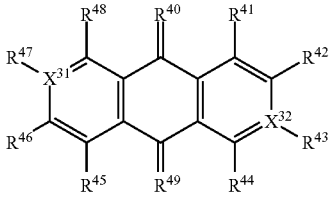

In Formula (7), $R^{40}$ and $R^{49}$ each independently represents an oxygen atom or a dicyanomethylene group; $R^{41}$ to $R^{48}$ each independently represents a hydrogen atom, a halogen atom, an alkyl group, a hydroxy group, or a carboxy group; and $X^{31}$ and $X^{32}$ each independently represents a carbon atom or a nitrogen atom, wherein when $X^{31}$ is a nitrogen atom, $R^{47}$ does not exist, and when $X^{32}$ is a nitrogen atom, $R^{43}$ does not exist.

Examples of the cyclopentadienylidene compound include compounds having a cyclopentadienylidene structure. The cyclopentadienylidene compound may have a condensed aromatic ring structure. Specific examples thereof include compounds represented by the following Formula (8):

(8)

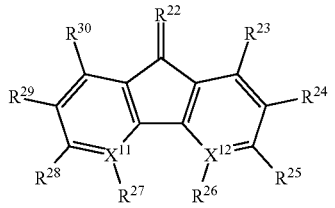

In Formula (8), $R^{22}$ represents an oxygen atom, a dicyanomethylene group, or a substituted or unsubstituted phenylimino group, the substituent of which is an alkyl group; $R^{23}$ to $R^{30}$ each independently represents a hydrogen atom, an alkoxycarbonyl group, or a nitro group; and $X^{11}$ and $X^{12}$ each independently represents a carbon atom or a nitrogen atom, wherein when $X^{11}$ is a nitrogen atom, $R^{27}$ does not exist, and when $X^{12}$ is a nitrogen atom, $R^{26}$ does not exist.

Examples of the azo compound include compounds having an azo group. Specific examples thereof include compounds represented by the following Formula (9):

$$R^{61}—N=NR^{63}—N=N—R^{62} \quad (9)$$

In Formula (9), $R^{63}$ represents a fluorenonediyl group, a diphenyloxadiazolediyl group, or an azoxybenzenediyl group; and $R^{61}$ and $R^{62}$ independently present a monovalent group having a structure represented by the following Formula (10) or (11):

(10)

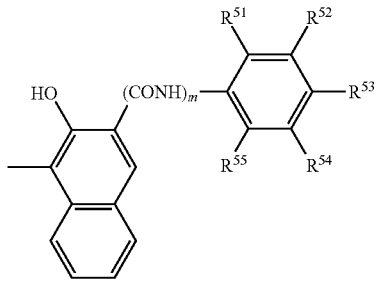

In Formula (10), $R^{51}$ to $R^{55}$ each independently represents a hydrogen atom, a halogen atom, or an alkyl group; and m is 1 or 2.

(11)

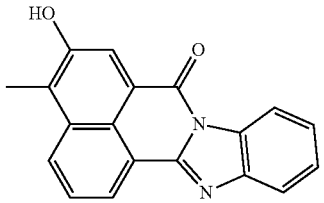

Examples of the alkyl group include a methyl group, an ethyl group, a propyl group, a butyl group, a pentyl group, a hexyl group, a heptyl group, an octyl group, a nonyl group, a decyl group, an undecyl group, and a dodecyl group.

The haloalkyl group means an alkyl group substituted by a halogen atom, and examples thereof include methyl, ethyl, propyl, butyl, pentyl, hexyl, heptyl, octyl, nonyl, decyl, undecyl, and dodecyl groups that are each substituted by a fluorine, chlorine, bromine, or iodine atom.

The hydroxyalkyl group means an alkyl group substituted by a hydroxy group, and examples thereof include methyl, ethyl, propyl, butyl, pentyl, hexyl, heptyl, octyl, nonyl, decyl, undecyl, and dodecyl groups that are each substituted by a hydroxy group.

Examples of the halogen atom include a fluorine atom, a chlorine atom, a bromine atom, and an iodine atom.

Examples of the alkoxy group include a methoxy group, an ethoxy group, a propoxy group, a butoxy group, a pentoxy group, a hexoxy group, a heptoxy group, an octoxy group, a nonoxy group, a decoxy group, an undecoxy group, and a dodecoxy group.

Examples of the compound (charge-transporting pigment particles) represented by Formula (1) are shown below.

| | $n^1$ | $R^1$ | $R^2$ |
|---|---|---|---|
| (E101) | 1 | phenyl group | phenyl group |
| (E102) | 1 | 3,5-bis(trifluoromethyl) phenyl group | 3,5-bis(trifluoromethyl) phenyl group |
| (E103) | 1 | 4-(trifluoromethyl)phenyl group | 5-(trifluoromethyl)phenyl group |
| (E104) | 1 | 4-cyanophenyl group | 4-cyanophenyl group |
| (E105) | 1 | 2-ethyl-6-methylphenyl group | ethoxyethyl group |
| (E106) | 1 | 2-methyl-4-nitrophenyl group | 2-methyl-4-nitrophenyl group |
| (E107) | 1 | 4-pyridyl group | 4-pyridyl group |
| (E108) | 1 | 4-hydroxyphenyl group | 4-hydroxyphenyl group |
| (E109) | 1 | 2,6-diethylphenyl group | 2-(2-hydroxyethyl)phenyl group |
| (E110) | 1 | 2-methyl-4-nitrophenyl group | 2,6-diethyl-3-chlorophenyl group |
| (E111) | 1 | 1-methylethyl group | 1-methylethyl group |
| (E112) | 1 | hexyl group | hexyl group |
| (E113) | 1 | isobutyl group (2-methylpropyl group) | 4-cyanophenyl group |
| (E114) | 1 | 4-carboxypentyl group | 2-methyl-4-nitrophenyl group |
| (E115) | 1 | 4-carboxyphenyl group | phenyl group |
| (E116) | 2 | 3,5-dimethylphenyl group | 3,5-dimethylphenyl group |
| (E117) | 2 | 2-phenylethyl group | 2-phenylethyl group |
| (E118) | 2 | 4-(phenyldiazenyl)phenyl group | 4-(phenyldiazenyl)phenyl group |
| (E119) | 2 | 4-(2-bromoethyl)phenyl group | 2-hydroxyphenyl group |
| (E120) | 2 | 4-chlorophenyl group | 4-chlorophenyl group |

Examples of the compound (charge-transporting pigment particles) represented by Formula (2) are shown below.

| | $n^2$ | $R^3$ | $R^4$ | $R^5$ | $R^6$ |
|---|---|---|---|---|---|
| (E201) | 1 | hydrogen atom | hydrogen atom | hydrogen atom | hydrogen atom |
| (E202) | 1 | hydrogen atom | hydrogen atom | chlorine atom | chlorine atom |
| (E203) | 1 | hydrogen atom | hydrogen atom | bromine atom | hydrogen atom |
| (E204) | 1 | methyl group | hydrogen atom | hydrogen atom | hydrogen atom |
| (E205) | 1 | ethyl group | ethyl group | ethyl group | ethyl group |
| (E206) | 1 | chlorine atom | chlorine atom | chlorine atom | chlorine atom |
| (E207) | 1 | butyl group | hydrogen atom | butyl group | hydrogen atom |
| (E208) | 2 | hydrogen atom | hydrogen atom | hydrogen atom | hydrogen atom |
| (E209) | 2 | hydrogen atom | hydrogen atom | chlorine atom | chlorine atom |
| (E210) | 2 | hydrogen atom | hydrogen atom | bromine atom | hydrogen atom |

Examples of the compound (charge-transporting pigment particles) represented by Formula (3) are shown below.

| | $n^3$ | $R^7$ | $R^8$ | $R^9$ | $R^{10}$ |
|---|---|---|---|---|---|
| (E301) | 1 | hydrogen atom | hydrogen atom | hydrogen atom | hydrogen atom |
| (E302) | 1 | methyl group | methyl group | methyl group | methyl group |
| (E303) | 1 | chlorine atom | chlorine atom | chlorine atom | chlorine atom |
| (E304) | 1 | hydrogen atom | hydrogen atom | chlorine atom | chlorine atom |
| (E305) | 1 | hydrogen atom | hydrogen atom | bromine atom | hydrogen atom |
| (E306) | 1 | ethyl group | hydrogen atom | hydrogen atom | hydrogen atom |

-continued

| | $n^3$ | $R^7$ | $R^8$ | $R^9$ | $R^{10}$ |
|---|---|---|---|---|---|
| (E307) | 1 | isobutyl group (2-methylpropyl group) | hydrogen atom | hydrogen atom | isobutyl group (2-methylpropyl group) |
| (E308) | 2 | hydrogen atom | hydrogen atom | hydrogen atom | hydrogen atom |
| (E309) | 2 | methyl group | methyl group | methyl group | methyl group |
| (E310) | 2 | chlorine atom | chlorine atom | chlorine atom | chlorine atom |

Examples of the compound (charge-transporting pigment particles) represented by Formula (4) are shown below.

| | $n^4$ | $R^{11}$ | $R^{12}$ | $R^{13}$ |
|---|---|---|---|---|
| (E401) | 1 | hydrogen atom | hydrogen atom | 1-(hydroxymethyl) propyl group |
| (E402) | 1 | hydrogen atom | hydrogen atom | 2-chlorophenyl group |
| (E403) | 1 | hydrogen atom | hydrogen atom | 3-nitrophenyl group |
| (E404) | 1 | hydrogen atom | hydrogen atom | 3-cyanophenyl group |
| (E405) | 1 | hydrogen atom | hydrogen atom | 4-(trifluoromethyl) phenyl group |
| (E406) | 1 | methyl group | methyl group | 4-(2-methylpropan-2-yl) phenyl group |
| (E407) | 1 | hydrogen atom | hydrogen atom | 2,6-diethylphenyl group |
| (E408) | 1 | hydrogen atom | hydrogen atom | cyclohexyl group |
| (E409) | 1 | chlorine atom | chlorine atom | phenyl group |
| (E410) | 1 | methyl group | hydrogen atom | 2,3-dimethylphenyl group |
| (E411) | 1 | nitro group | hydrogen atom | 1-naphthyl group |
| (E412) | 1 | butyl group | hydrogen atom | 4-carboxyhexyl group |
| (E413) | 1 | propyl group | hydrogen atom | 2,6-diethylphenyl group |
| (E414) | 1 | hydrogen atom | hydrogen atom | 4-(2-chloroethyl)phenyl group |
| (E415) | 2 | hydrogen atom | hydrogen atom | hydrogen atom |
| (E416) | 2 | propyl group | propyl group | 2-carboxyphenyl group |
| (E417) | 2 | hydrogen atom | hydrogen atom | 2-nitrophenyl group |

Examples of the compound (charge-transporting pigment particles) represented by Formula (5) are shown below.

| | $R^{14}$ | $R^{15}$ | $R^{16}$ | $R^{17}$ | $R^{18}$ | $R^{19}$ | $R^{20}$ | $R^{21}$ |
|---|---|---|---|---|---|---|---|---|
| (E501) | hydrogen atom | hydrogen atom | hydrogen atom | hydrogen atom | hydrogen atom | hydrogen atom | hydrogen atom | hydrogen atom |
| (E502) | methyl group | hydrogen atom | hydrogen atom | methyl group | methyl group | hydrogen atom | hydrogen atom | methyl group |
| (E503) | ethyl group | hydrogen atom | hydrogen atom | ethyl group | ethyl group | hydrogen atom | hydrogen atom | ethyl group |
| (E504) | methyl group | hydrogen atom | hydrogen atom | tert-butyl group (2-methylpropan-2-yl group) | methyl group | hydrogen atom | hydrogen atom | tert-butyl group (2-methylpropan-2-yl group) |
| (E505) | tert-butyl group (2-methylpropan-2-yl group) | hydrogen atom | hydrogen atom | tert-butyl group (2-methylpropan-2-yl group) | tert-butyl group (2-methylpropan-2-yl group) | hydrogen atom | hydrogen atom | tert-butyl group (2-methylpropan-2-yl group) |
| (E506) | methyl group | methyl group | methyl group | methyl group | methyl group | methyl group | methyl group | methyl group |

-continued

| | $R^{14}$ | $R^{15}$ | $R^{16}$ | $R^{17}$ | $R^{18}$ | $R^{19}$ | $R^{20}$ | $R^{21}$ |
|---|---|---|---|---|---|---|---|---|
| (E507) | tert-butyl group (2-methylpropan-2-ylgroup) | hydrogen atom | —CH═CH—CH═CH— | | —CH═CH—CH═CH— | | hydrogen atom | tert-butyl group (2-methylpropan-2-yl group) |

Examples of the compound (charge-transporting pigment particles) represented by Formula (6) are shown below.

| | $X^{21}$ | $X^{22}$ | $R^{31}$ | $R^{32}$ | $R^{33}$ | $R^{34}$ |
|---|---|---|---|---|---|---|
| (E601) | nitrogen atom | nitrogen atom | oxygen atom | hydrogen atom | hydrogen atom | hydrogen atom |
| (E602) | nitrogen atom | nitrogen atom | oxygen atom | hydrogen atom | bromine atom | hydrogen atom |
| (E603) | nitrogen atom | nitrogen atom | oxygen atom | hydrogen atom | phenyl group | hydrogen atom |
| (E604) | nitrogen atom | nitrogen atom | oxygen atom | hydrogen atom | hydrogen atom | chlorine atom |
| (E605) | nitrogen atom | nitrogen atom | oxygen atom | phenyl group | hydrogen atom | hydrogen atom |
| (E606) | nitrogen atom | nitrogen atom | oxygen atom | hydrogen atom | hydrogen atom | 4-carboxybutyl group |
| (E607) | nitrogen atom | nitrogen atom | dicyanomethylene group | hydrogen atom | hydrogen atom | hydrogen atom |
| (E608) | nitrogen atom | nitrogen atom | dicyanomethylene group | hydrogen atom | 2-methylphenyl group | hydrogen atom |
| (E609) | carbon atom | carbon atom | dicyanomethylene group | hydrogen atom | hydrogen atom | hydrogen atom |
| (E610) | carbon atom | carbon atom | dicyanomethylene group | ethyl group | ethyl group | hydrogen atom |
| (E611) | carbon atom | carbon atom | dicyanomethylene group | hydrogen atom | hydrogen atom | 2-ethylphenyl group |
| (E612) | carbon atom | carbon atom | oxygen atom | hydrogen atom | hydrogen atom | 2-(trifluoromethyl)phenyl group |
| (E613) | carbon atom | carbon atom | oxygen atom | hydrogen atom | hydrogen atom | 3-nitrophenyl group |
| (E614) | carbon atom | carbon atom | oxygen atom | hydrogen atom | hydrogen atom | 4-cyanophenyl group |
| (E615) | carbon atom | carbon atom | oxygen atom | hydrogen atom | hydrogen atom | pentafluorophenyl group |
| (E616) | carbon atom | carbon atom | oxygen atom | hydrogen atom | hydrogen atom | hydrogen atom |
| (E617) | carbon atom | carbon atom | oxygen atom | hydrogen atom | 3-hydroxypropyl group | hydrogen atom |
| (E618) | carbon atom | carbon atom | oxygen atom | methyl group | 2-ethylphenyl group | methyl group |
| (E619) | carbon atom | carbon atom | oxygen atom | hydrogen atom | hydrogen atom | hydrogen atom |
| (E620) | carbon atom | carbon atom | oxygen atom | 2-(2-chloroethyl)phenyl group | hydrogen atom | hydrogen atom |

| | $R^{35}$ | $R^{36}$ | $R^{37}$ | $R^{38}$ | $R^{39}$ |
|---|---|---|---|---|---|
| (E601) | — | — | hydrogen atom | hydrogen atom | hydrogen atom |
| (E602) | — | — | hydrogen atom | bromine atom | hydrogen atom |
| (E603) | — | — | hydrogen atom | phenyl group | hydrogen atom |
| (E604) | — | — | chlorine atom | hydrogen atom | hydrogen atom |
| (E605) | — | — | hydrogen atom | hydrogen atom | phenyl group |
| (E606) | — | — | hydrogen atom | hydrogen atom | hydrogen atom |
| (E607) | — | — | hydrogen atom | hydrogen atom | hydrogen atom |
| (E608) | — | — | hydrogen atom | 2-methylphenyl group | hydrogen atom |
| (E609) | hydrogen atom | hydrogen atom | hydrogen atom | hydrogen atom | 3-nitrophenyl group |
| (E610) | hydrogen atom | hydrogen atom | hydrogen atom | ethyl group | ethyl group |
| (E611) | hydrogen atom | hydrogen atom | 2-ethylphenyl group | hydrogen atom | hydrogen atom |
| (E612) | hydrogen atom | hydrogen atom | 4-(trifluoromethyl)phenyl group | hydrogen atom | hydrogen atom |
| (E613) | hydrogen atom | hydrogen atom | 3-nitrophenyl group | hydrogen atom | hydrogen atom |
| (E614) | hydrogen atom | hydrogen atom | 4-cyanophenyl group | hydrogen atom | hydrogen atom |

-continued

| | | | | | |
|---|---|---|---|---|---|
| (E615) | hydrogen atom | hydrogen atom | pentafluorophenyl group | hydrogen atom | hydrogen atom |
| (E616) | nitro group | nitro group | hydrogen atom | hydrogen atom | hydrogen atom |
| (E617) | hydrogen atom | hydrogen atom | hydrogen atom | hydrogen atom | hydrogen atom |
| (E618) | methyl group | methyl group | methyl group | 2-ethylphenyl group | methyl group |
| (E619) | 4-carboxyphenyl group | hydrogen atom | hydrogen atom | hydrogen atom | hydrogen atom |
| (E620) | hydrogen atom | hydrogen atom | hydrogen atom | hydrogen atom | 4-(2-bromoethyl)phenyl group |

Examples of the compound (charge-transporting pigment particles) represented by Formula (7) are shown below.

| | $X^{31}$ | $X^{32}$ | $R^{40}$ | $R^{41}$ | $R^{42}$ | $R^{43}$ |
|---|---|---|---|---|---|---|
| (E701) | nitrogen atom | nitrogen atom | oxygen atom | hydrogen atom | hydrogen atom | — |
| (E702) | nitrogen atom | nitrogen atom | oxygen atom | hydrogen atom | ethyl group | — |
| (E703) | nitrogen atom | nitrogen atom | dicyanomethylene group | methyl group | hydrogen atom | — |
| (E704) | carbon atom | carbon atom | oxygen atom | fluorine atom | hydrogen atom | hydrogen atom |
| (E705) | carbon atom | carbon atom | oxygen atom | hydrogen atom | hydrogen atom | hydrogen atom |
| (E706) | carbon atom | carbon atom | oxygen atom | hydrogen atom | hydrogen atom | hydrogen atom |
| (E707) | carbon atom | carbon atom | oxygen atom | hydrogen atom | hydrogen atom | hydrogen atom |
| (E708) | carbon atom | carbon atom | oxygen atom | hydrogen atom | hydrogen atom | hydrogen atom |
| (E709) | carbon atom | carbon atom | dicyanomethylene group | hydrogen atom | hydrogen atom | hydrogen atom |
| (E710) | carbon atom | carbon atom | dicyanomethylene group | hydrogen atom | hydrogen atom | hydrogen atom |

| | $R^{44}$ | $R^{45}$ | $R^{46}$ | $R^{47}$ | $R^{48}$ | $R^{49}$ |
|---|---|---|---|---|---|---|
| (E701) | hydrogen atom | hydrogen atom | hydrogen atom | — | hydrogen atom | oxygen atom |
| (E702) | hydrogen atom | hydrogen atom | ethyl group | — | hydrogen atom | oxygen atom |
| (E703) | hydrogen atom | methyl group | hydrogen atom | — | hydrogen atom | dicyanomethylene group |
| (E704) | fluorine atom | hydrogen atom | hydrogen atom | hydrogen atom | hydrogen atom | oxygen atom |
| (E705) | hydrogen atom | hydrogen atom | hydrogen atom | hydrogen atom | hydrogen atom | oxygen atom |
| (E706) | hydrogen atom | hydrogen atom | hydrogen atom | hydroxy group | hydrogen atom | oxygen atom |
| (E707) | carboxy group | hydrogen atom | hydrogen atom | hydrogen atom | hydrogen atom | oxygen atom |
| (E708) | bromine atom | bromine atom | hydrogen atom | hydrogen atom | hydrogen atom | oxygen atom |
| (E709) | hydrogen atom | hydrogen atom | hydrogen atom | hydrogen atom | hydrogen atom | dicyanomethylene group |
| (E710) | hydrogen atom | hydrogen atom | hydrogen atom | tert-butyl group (2-methylpropan-2-yl group) | hydrogen atom | dicyanomethylene group |

Examples of the compound (charge-transporting pigment particles) represented by Formula (8) are shown below.

| | $X^{11}$ | $X^{12}$ | $R^{22}$ | $R^{23}$ | $R^{24}$ | $R^{25}$ |
|---|---|---|---|---|---|---|
| (E801) | nitrogen atom | nitrogen atom | dicyanomethylene group | hydrogen atom | hydrogen atom | hydrogen atom |
| (E802) | nitrogen atom | nitrogen atom | oxygen atom | hydrogen atom | hydrogen atom | hydrogen atom |

-continued

| | | | | | |
|---|---|---|---|---|---|
| (E803) | nitrogen atom | nitrogen atom | phenylimino group | hydrogen atom | hydrogen atom | hydrogen atom |
| (E804) | carbon atom | carbon atom | dicyanomethylene group | hydrogen atom | hydrogen atom | hydrogen atom |
| (E805) | carbon atom | carbon atom | dicyanomethylene group | butoxycarbonyl group | hydrogen atom | hydrogen atom |
| (E806) | carbon atom | carbon atom | phenylimino group | hydrogen atom | hydrogen atom | hydrogen atom |
| (E807) | carbon atom | carbon atom | 2,6-diethylphenylimino group | hydrogen atom | nitro group | hydrogen atom |
| (E808) | carbon atom | carbon atom | oxygen atom | hydrogen atom | hydrogen atom | hydrogen atom |

| | $R^{26}$ | $R^{27}$ | $R^{28}$ | $R^{29}$ | $R^{30}$ |
|---|---|---|---|---|---|
| (E801) | — | — | hydrogen atom | hydrogen atom | hydrogen atom |
| (E802) | — | — | hydrogen atom | hydrogen atom | hydrogen atom |
| (E803) | — | — | hydrogen atom | hydrogen atom | hydrogen atom |
| (E804) | hydrogen atom | octoxycarbonyl group | hydrogen atom | hydrogen atom | hydrogen atom |
| (E805) | hydrogen atom | hydrogen atom | hydrogen atom | hydrogen atom | hydrogen atom |
| (E806) | hydrogen atom | hydrogen atom | hydrogen atom | hydrogen atom | hydrogen atom |
| (E807) | nitro group | hydrogen atom | hydrogen atom | nitro group | hydrogen atom |
| (E808) | hydrogen atom | hydrogen atom | hydrogen atom | hydrogen atom | hydrogen atom |

Examples of the compound (charge-transporting pigment particles) represented by Formula (9) are shown below.

| | $R^{61}$ | $R^{62}$ | $R^{63}$ |
|---|---|---|---|
| (E901) | Formula (10)/(E1002) | Formula (10)/(E1002) | fluorenonediyl group |
| (E902) | Formula (10)/(E1002) | Formula (10)/(E1003) | fluorenonediyl group |
| (E903) | Formula (11) | Formula (10)/(E1006) | fluorenonediyl group |
| (E904) | Formula (10)/(E1004) | Formula (10)/(E1004) | diphenyloxadiazolediyl group |
| (E905) | Formula (11) | Formula (11) | diphenyloxadiazolediyl group |
| (E906) | Formula (11) | Formula (10)/(E1001) | diphenyloxadiazolediyl group |
| (E907) | Formula (10)/(E1004) | Formula (10)/(E1004) | azoxybenzenediyl group |
| (E908) | Formula (11) | Formula (10)/(E1005) | azoxybenzenediyl group |
| (E909) | Formula (11) | Formula (11) | azoxybenzenediyl group |

Examples of the monovalent group having a structure represented by Formula (10) are shown below.

| | m | $R^{51}$ | $R^{52}$ | $R^{53}$ | $R^{54}$ | $R^{55}$ |
|---|---|---|---|---|---|---|
| (E1001) | 1 | hydrogen atom | hydrogen atom | hydrogen atom | hydrogen atom | hydrogen atom |
| (E1002) | 1 | chlorine atom | hydrogen atom | hydrogen atom | hydrogen atom | hydrogen atom |
| (E1003) | 1 | hydrogen atom | methyl group | hydrogen atom | hydrogen atom | hydrogen atom |
| (E1004) | 2 | chlorine atom | hydrogen atom | hydrogen atom | hydrogen atom | hydrogen atom |
| (E1005) | 2 | hydrogen atom | hydrogen atom | ethyl group | hydrogen atom | hydrogen atom |
| (E1006) | 2 | hydrogen atom | hydrogen atom | hydrogen atom | tert-butyl group (2-methyl-propan-2-yl group) | hydrogen atom |

The charge-transporting organic pigment particles (charge-transporting compound) can be obtained as follows.

The compound represented by Formula (1) can be synthesized by, for example, a method described in U.S. Pat. No. 4,442,193, U.S. Pat. No. 4,992,349, or U.S. Pat. No. 5,468,583. For example, the compound can be synthesized by a reaction of naphthalenetetracarboxylic acid dianhydride, which can be purchased from Tokyo Chemical Industry Co., Ltd., Sigma-Aldrich Japan K.K., or Johnson Matthey Japan Inc. as a reagent, and a monoamine derivative or by a reaction of perylenetetracarboxylic acid dianhydride and a monoamine derivative.

The compound represented by Formula (2) and the compound represented by Formula (3) can be synthesized by, for example, a method described in U.S. Pat. No. 4,442,193, U.S. Pat. No. 4,992,349, or U.S. Pat. No. 5,468,583 by using a 1,2-dianiline derivative instead of the monoamine derivative. The 1,2-dianiline derivative can be purchased from Tokyo Chemical Industry Co., Ltd., Sigma-Aldrich Japan K.K., or Johnson Matthey Japan Inc. as a reagent.

The compound represented by Formula (4) can be synthesized by, for example, a method described in Japanese Patent Laid-Open No. 2004-093791 or Japanese Patent Laid-Open No. 7-89962. For example, the compound can be synthesized by a reaction of naphthalenetetracarboxylic acid dianhydride and a 1,2-dianiline derivative, which can be purchased from Tokyo Chemical Industry Co., Ltd., Sigma-Aldrich Japan K.K., or Johnson Matthey Japan Inc. as reagents, and an amine derivative or by a reaction of perylenetetracarboxylic acid dianhydride, a 1,2-dianiline derivative, and an amine derivative.

The compound represented by Formula (5) can be synthesized by, for example, a method described in Japanese Patent Laid-Open No. 1-206349 or the Proceedings of PPCI/Japan Hard Copy, '98, p. 207 (1998). For example, the compound can be synthesized using a phenol derivative as a raw material, which can be purchased from Tokyo Chemical Industry Co., Ltd. or Sigma-Aldrich Japan K.K. as a reagent.

The compound represented by Formula (6) can be purchased from, for example, Tokyo Chemical Industry Co., Ltd., Sigma-Aldrich Japan K.K., or Johnson Matthey Japan Inc. as a reagent or can be synthesized by a method described in Bull. Chem. Soc. Jpn., Vol. 65, pp. 116-1011 (1992) or Chem. Educator, No. 6, pp. 227-234 (2001) using a commercially available phenanthrene derivative or phenanthroline derivative. In addition, a substituent can be introduced to a halide of the phenanthrene derivative or the phenanthroline derivative described in these documents by, for example, a cross-coupling reaction using a palladium catalyst. A dicyanomethylene group can also be introduced into such a compound by a reaction between the compound and malononitrile.

The compound represented by Formula (7) can be purchased from, for example, Tokyo Chemical Industry Co., Ltd., Sigma-Aldrich Japan K.K., or Johnson Matthey Japan Inc. as a reagent or can be synthesized by a method described in Synthesis, Vol. 5, pp. 388-389 (1988) using commercially available compounds. A dicyanomethylene group can also be introduced into such a compound by a reaction between the compound and malononitrile.

The compound represented by Formula (8) can be purchased from, for example, Tokyo Chemical Industry Co., Ltd., Sigma-Aldrich Japan K.K., or Johnson Matthey Japan Inc. as a reagent or can be synthesized by a method described in Japanese Patent Laid-Open No. 5-279582, U.S. Pat. No. 4,562,132, or Japanese Patent Laid-Open No. 7-70038 using a commercially available fluorenone derivative, aniline derivative, malononitrile, and other compounds.

The compound represented by Formula (9) can be synthesized by, for example, a method described in Journal of the Imaging Society of Japan, Vol. 37, No. 3, pp. 280-288 (1998).

The polyolefin polymer of the polyolefin polymer particles that are used in the present invention is a polymer obtained by polymerization of olefin. The term "olefin" refers to a hydrocarbon compound having one or more C=C (double bond between carbon atoms). The polyolefin polymer may be a polymer obtained by polymerization of olefin only or a polymer (copolymer) obtained by copolymerization of olefin and another monomer.

In order to improve the liquid stability (dispersion stability) in the case of storing a dispersion solution containing charge-transporting pigment particles for a long time, the polyolefin polymer that is used in the present invention can include the following (A1), (A2), and (A3) in a mass ratio satisfying the following expression:

$$0.01 \leq (A2)/\{(A1)+(A2)+(A3)\} \times 100 \leq 30, \text{ and}$$

$$55/45 \leq (A1)/(A3) \leq 99/1.$$

(A1) is a repeating structural unit represented by the following Formula (121):

(121)

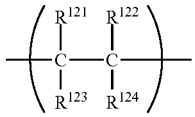

wherein, $R^{121}$ to $R^{124}$ each independently represents a hydrogen atom or an alkyl group.

(A2) is a repeating structural unit represented by the following Formula (131) or (132):

(131)

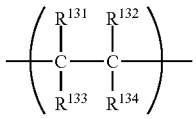

(132)

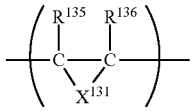

wherein, $R^{131}$ to $R^{134}$ each independently represents a hydrogen atom, an alkyl group, a phenyl group, or a monovalent group represented by $—Y^{131}COOH$ ($Y^{131}$ represents a single bond, an alkylene group, or an arylene group), wherein at least one of $R^{131}$ to $R^{134}$ is a monovalent group represented by $—Y^{131}COOH$; $R^{135}$ and $R^{136}$ each independently represents a hydrogen atom, an alkyl group, or a phenyl group; and $X^{131}$ represents a divalent group represented by $—Y^{132}COOCOY^{133}—$ ($Y^{132}$ and $Y^{133}$ each independently represents a single bond, an alkylene group, or an arylene group).

(A3) is a repeating structural unit represented by the following Formula (141), (142), (143), or (144):

(141)

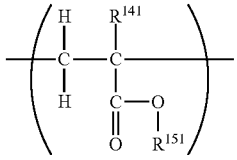

(142)

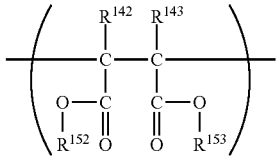

(143)

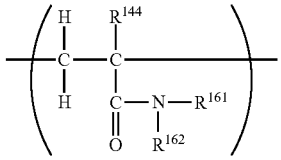

-continued (144)

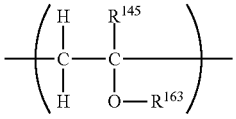

wherein, $R^{141}$ to $R^{145}$ each independently represents a hydrogen atom or a methyl group; $R^{51}$ to $R^{153}$ each independently represents an alkyl group having 1 to 10 carbon atoms; and $R^{161}$ to $R^{163}$ each independently represents a hydrogen atom or an alkyl group having 1 to 10 carbon atoms.

Examples of the alkyl group include a methyl group, an ethyl group, a propyl group, a butyl group, a pentyl group, a hexyl group, a heptyl group, an octyl group, a nonyl group, and a decyl group.

Examples of the alkylene group include a methylene group, an ethylene group, a propylene group, a butylene group, a pentylene group, a hexylene group, a heptylene group, an octylene group, a nonylene group, and a decylene group.

Examples of the arylene group include a phenylene group, a biphenylene group, and a naphthylene group.

In Formula (121), $R^{121}$ to $R^{124}$ can be hydrogen atoms. The repeating structural unit represented by Formula (121) can be introduced into the polyolefin polymer by a polymerization reaction in the presence of a monomer having a carbon-carbon double bond. Examples of the monomer include ethylene, propylene, 1-butene, isobutene, 1-pentene, 4-methyl-1-pentene, 3-methyl-1-pentene, and 1-hexene.

In Formula (131), $R^{131}$ and $R^{133}$ can be hydrogen atoms; $R^{132}$ can be a hydrogen atom or a methyl group; and $R^{134}$ can be a monovalent group represented by —COOH (carboxy group).

In Formula (132), $R^{135}$ can be a hydrogen atom; and $R^{136}$ can be a hydrogen atom or a methyl group. In the repeating structural unit represented by Formula (131) and the repeating structural unit represented by Formula (132), unsaturated carboxylic acid and/or its anhydride can be introduced into the polyolefin polymer by a polymerization reaction in the presence of a monomer having at least one carboxy group and/or at least one acid anhydride group in the molecule (in the monomer unit). Examples of the monomer include acrylic acid, methacrylic acid, maleic acid, maleic anhydride, itaconic acid, itaconic anhydride, fumaric acid, crotonic acid, and half esters and half amides of unsaturated dicarboxylic acids. Above all, acrylic acid, methacrylic acid, or maleic acid (anhydride), in particular, acrylic acid or maleic anhydride can be used.

In Formula (141), $R^{151}$ can be a methyl group or an ethyl group. The repeating structural unit represented by Formula (141) can be introduced into the polyolefin polymer by a polymerization reaction in the presence of a (meth)acrylate monomer. Examples of the monomer include methyl (meth) acrylate, ethyl (meth)acrylate, and butyl (meth)acrylate.

In Formula (142), $R^{152}$ and $R^{153}$ can be methyl groups, ethyl groups, or butyl groups. The repeating structural unit represented by Formula (142) can be introduced into the polyolefin polymer by a polymerization reaction in the presence of a maleate ester monomer. Examples of the monomer include dimethyl maleate, diethyl maleate, and butyl maleate.

In Formula (143), $R^{161}$ and $R^{162}$ can be hydrogen atoms. The repeating structural unit represented by Formula (143) can be introduced into the polyolefin polymer by a polymerization reaction in the presence of an amide acrylate monomer.

In Formula (144), $R^{163}$ can be a methyl group or an ethyl group. The repeating structural unit represented by Formula (144) can be introduced into the polyolefin polymer by a polymerization reaction in the presence of an alkylvinyl ether monomer and a vinyl alcohol monomer. Examples of the monomer include vinyl alcohols obtained by saponification of methyl vinyl ether, ethyl vinyl ether, or vinyl ester with a basic compound.

Above all, the repeating structural unit represented by Formula (141) can be particularly used.

Furthermore, the particle diameter of the polyolefin polymer particles can be easily reduced by adjusting the value of (A2)/{(A1)+(A2)+(A3)} to 0.01 or more. In addition, the liquid stability in the case of storing the dispersion solution for a long time can be further improved by adjusting the value of (A2)/{(A1)+(A2)+(A3)} to 30 or less.

In addition, the liquid stability in the case of storing the dispersion solution for a long time is further improved by adjusting the ratio of (A1)/(A3) to 55/45 or more, and the particle diameter of the polyolefin polymer particles can be reduced by adjusting the ratio of (A1)/(A3) to 99/1 or less.

In a particular polyolefin polymer, (A1) is a repeating structural unit represented by Formula (121) where $R^{121}$ to $R^{124}$ are hydrogen atoms; (A2) is a repeating structural unit represented by Formula (132) where $R^{135}$ and $R^{136}$ are hydrogen atoms, and $X^{131}$ is —$Y^{132}$COOCO$Y^{133}$— ($Y^{132}$ and $Y^{133}$ are single bonds); and (A3) is a repeating structural unit represented by Formula (141) where $R^{141}$ is a hydrogen atom, and $R^{151}$ is a methyl group or an ethyl group.

When the polyolefin polymer is in the dried state, a carboxylic anhydride structure derived from, for example, maleic anhydride forms an acid anhydride structure by cyclodehydration of two adjacent carboxy groups. However, in particular, in a dispersion solution containing a basic compound, partial or full ring opening of the anhydride groups occurs to easily form a structure of a carboxy group or its salt.

In the present invention, when an amount is defined based on the amount of carboxyl groups of a polyolefin polymer, the amount is calculated assuming that all acid anhydride groups in the polyolefin polymer are ring-opened to form carboxy groups.

The polyolefin polymer that is used in the present invention may contain a repeating structural unit derived from a monomer other than the above-mentioned monomers. In such a case, the content of the repeating structural unit derived from the monomer other than the above-mentioned monomers can be 20 mass % or less based on the total mass of the polyolefin polymer. Examples of such optional monomers include alkyl vinyl ethers having 3 to 30 carbon atoms, such as methyl vinyl ether and ethyl vinyl ether, dienes, (meth) acrylonitrile, halogenated vinyls, halogenated vinylidenes, carbon monoxide, and sulfur dioxide.

The polyolefin polymer that is used in the present invention may be a synthesized polymer or a commercially available polymer.

The polyolefin polymer can be obtained by, for example, high-pressure radical copolymerization of monomers (such as olefin monomers) for synthesizing the polyolefin polymer in the presence of a radical generator. The method of synthesizing the polyolefin polymer is described in, for example, the chapters 1 to 4 of New Polymer Experiment 2 Synthesis and Reaction of Polymer (1) (Kyoritsu Shuppan Co., Ltd.), Japanese Patent Laid-Open No. 2003-105145, or Japanese Patent Laid-Open No. 2003-147028.

Examples of the commercially available polyolefin polymers include "BONDINE (trade name)" manufactured by Sumitomo Chemical Co., Ltd. and "Primacor (trade name)" manufactured by The Dow Chemical Company.

Next, a method of preparing a dispersion solution that is used for a forming charge-transporting layer in the present invention (hereinafter also referred to as "dispersion solution for charge-transporting layer") will be described.

From the viewpoint of dispersibility, the dispersion solution for charge-transporting layer can be prepared by dispersing polyolefin polymer particles in water as a dispersion medium, then adding charge-transporting pigment particles to the resulting dispersion solution, and further subjecting the resulting mixture to dispersion treatment. This method will be described in detail below.

The dispersion solution of polyolefin polymer particles can be prepared by, for example, heating and mixing (dispersion treatment) a polyolefin polymer, water as the dispersion medium, and, optionally, an organic solvent in a sealable disperser. The shape of the polyolefin polymer in such a method is not particularly limited, but particles having a diameter of 1 cm or less (such as 0.8 cm or less) can be used from the viewpoint of increasing the particle-forming rate.

As the disperser, an apparatus that has a tank in which a liquid can be put and can moderately stir the mixture of a dispersoid and a dispersion medium in the tank can be used. Examples of such a disperser include a solid/liquid stirring machine and an emulsifier. In particular, a disperser that can apply a pressure of 0.1 MPa or more can be used.

Polyolefin polymer particles as the dispersoid and water as the dispersion medium (and an optional organic solvent) are put in the tank of a disperser and are mixed by stirring at 40° C. or less for example. Then, the stirring (dispersion treatment) is continued while maintaining the temperature inside the tank at 50 to 200° C., preferably 60 to 200° C., for 5 to 120 minutes to obtain a dispersion solution of the polyolefin polymer particles. In the case of a polyolefin polymer having a carboxylic acid unit such as a repeating structural unit represented by Formula (131) or (132), a basic compound that can anionize the carboxylic acid unit in water serving as the dispersion solvent can be added, in order to enhance the dispersibility of the polyolefin polymer particles. The amount of the basic compound to be added can be 0.5 to 3.0 equivalents, such as 0.8 to 2.5 equivalents or 1.0 to 2.0 equivalents, to the carboxy groups (one mole of the acid anhydride group is regarded as two moles of the carboxy group) in the polyolefin polymer. In an amount of 0.5 equivalents or more, the effect of the basic compound is high, and in an amount of 3.0 equivalents or less, the time for heating a coating can be shortened, and coloring of the dispersion solution due to the basic compound can be prevented.

The basic compound can be a compound that volatiles during heating of a coating of the dispersion solution. Specific examples of the compound include ammonia and organic amine compounds. Examples of the organic amine compound include triethylamine, N,N-dimethylethanolamine, aminoethanolamine, N-methyl-N,N-diethanolamine, isopropylamine, iminobispropylamine, ethylamine, diethylamine, 3-ethoxypropylamine, 3-diethylaminopropylamine, sec-butylamine, propylamine, methylaminopropylamine, methyliminobispropylamine, 3-methoxypropylamine, monoethanolamine, diethanolamine, triethanolamine, morpholine, N-methylmorpholine, and N-ethylmorpholine.

A dispersion solution for charge-transporting layer that is used in the present invention can be obtained by adding charge-transporting pigment particles to the thus-prepared dispersion solution of polyolefin polymer particles and further performing dispersion treatment.

The dispersion treatment can be performed by, for example, using a disperser such as a paint shaker, a ball mill, a sand mill, an ultrasonic disperser, a high-pressure homogenizer, a stirrer, a mixer, or an agitator.

At least one of the dispersion media used in the dispersion solution for charge-transporting layer according to the present invention can be water. From the viewpoint of improving coatability (inhibition of dewetting) of the dispersion solution for charge-transporting layer, a dispersion medium including both water and an organic solvent can be used. Examples of the organic solvent include ketones such as methyl ethyl ketone, acetone, and diethyl ketone; alcohols such as propanol, butanol, methanol, and ethanol; and ethers such as tetrahydrofuran, dioxane, and ethylene glycol monobutyl ether. In particular, alcohols can be used. The addition of the organic solvent can be performed during preparation of the dispersion solution of polyolefin polymer particles, during dispersion treatment of charge-transporting pigment particles in the prepared dispersion solution, or after the dispersion treatment. In the case of using a mixture of water and an alcohol as the dispersion medium, the amount of water can be 50 mass % or more based on the total mass of the water and the alcohol. By adjusting the mass ratio of water to 50% or more, the number average particle diameter of the particles composed of the polyolefin polymer particles and the charge-transporting pigment particles can be easily adjusted to 50 nm or more and 300 nm or less, and the degree of dispersion (standard deviation/number average particle diameter) of the particles can be easily adjusted to 1.0 or less.

The total amount of the polyolefin polymer particles and the charge-transporting pigment particles (the amount of particles composed of the polyolefin polymer particles and the charge-transporting pigment particles) contained in the dispersion solution of the charge-transporting layer according to the present invention can be 7 mass % or more and 20 mass % or less based on the total mass of the dispersion solution for charge-transporting layer. By adjusting the mass ratio of the polyolefin polymer particles and the charge-transporting pigment particles to 7% or more and 20% or less, the number average particle diameter of the particles composed of the polyolefin polymer particles and the charge-transporting pigment particles can be easily adjusted to 300 nm or less.

In the present invention, the number average particle diameter of the particles composed of the polyolefin polymer particles and the charge-transporting pigment particles contained in the dispersion solution for charge-transporting layer is 50 nm or more and 300 nm or less, and the degree of dispersion (standard deviation/number average particle diameter) is 1.0 or less. That is, the difference between the particle diameters of the polyolefin polymer particles and the charge-transporting pigment particles is small. Consequently, precipitation of the charge-transporting pigment particles is prevented. Accordingly, the liquid stability (dispersion stability) in the case of storing the dispersion solution for charge-transporting layer for a long time is high, and aggregation of the charge-transporting pigment particles during formation of a charge-transporting layer by melting the polyolefin polymer particles is prevented. The present inventors believe that this is caused by the following reasons.

Charge-transporting pigment particles (charge-transporting compound) generally include an aromatic ring having a high cohesive force in its molecule and are thereby tend to aggregate in a solution. Therefore, the charge-transporting pigment particles easily aggregate in a coating liquid where a binder resin is dissolved in a solvent, and the liquid stability (dispersion stability) tends to be insufficient. On the other hand, the present inventors have investigated and have found that the cohesive force of the charge-transporting pigment particles can be reduced, without dissolving a binder resin in a solvent, by letting polyolefin polymer particles present at surroundings of the charge-transporting pigment particles. The liquid stability (dispersion stability) can be improved to some extent by the presence of the polyolefin polymer particles, but the presence of the polyolefin polymer particles alone cannot sufficiently prevent (a) aggregation of the charge-transporting pigment particles during melting of the polyolefin polymer particles and (b) precipitation of the charge-transporting pigment particles due to gravity during the storage of the dispersion solution for charge-transporting layer for a long time.

Against this, it is believed that steric hindrance effect can be obtained by not only the presence of the polyolefin polymer particles but also a reduction in particle diameter of the charge-transporting pigment particles and also a reduction in difference between the particle diameters of the charge-transporting pigment particles and the polyolefin polymer particles present at the surroundings of the charge-transporting pigment particles, as in the present invention. This steric hindrance effect is believed to sufficiently prevent aggregation of the charge-transporting pigment particles in the dispersion solution for charge-transporting layer and sufficiently reduce the cohesive force of the charge-transporting pigment particles during melting of the polyolefin polymer particles.

In the present invention, the particle diameter of the particles composed of the polyolefin polymer particles and the charge-transporting pigment particles is measured by observing a prepared dispersion solution using a transmission electron microscope (TEM). Specifically, the dispersion solution is frozen and is observed using a TEM equipped with an energy filter having a cryo-transfer.

The number average particle diameter and the degree of dispersion (standard deviation/number average particle diameter) can be determined by measuring 200 particles randomly selected from the particles composed of the polyolefin polymer particles and the charge-transporting pigment particles without distinction.

The particles composed of the polyolefin polymer particles and the charge-transporting pigment particles are a mixture (a group of particles) of two types of particles, the polyolefin polymer particles and the charge-transporting pigment particles. As described above, in measurement of the number average particle diameter and the degree of dispersion of this particle mixture (the group of particles), the two types of particles contained in the particle mixture (the group of particles) are equally treated without distinction.

The term "number average particle diameter" in the present invention refers to the length of an edge of a particle when the particle is a so-called normal crystal such as a cube or an octahedron. When the particle is not a normal crystal, such as a spherical, bar-like, or plate-like shape, the number average particle diameter is determined using the diameter of a sphere having the same volume as that of the particle.

The TEM is set to a magnification of 5000- to 40000-fold, and the bright-field image is observed. The TEM is set to an application voltage of 80 to 200 kV.

Images obtained by the TEM are recorded on films, and the image on each film is resolved into 2048×2048 pixels and is subjected to image processing by a computer. In the case of processing an analog image recorded on a film, the image is converted into a digital image with a scanner, and shading correction and contrast/edge enhancement are performed as needed. Then, a histogram is drawn, and particle images are extracted by binary processing to determine the particle diameters of the particles.

In the present invention, application of the dispersion solution for charge-transporting layer can be performed by various methods that are used in the field of electrophotographic photosensitive member. Among such methods, dip coating can be particularly employed.

In the present invention, in the case of performing dip coating of the dispersion solution for charge-transporting layer, the application can be performed with a dip coater set to an environment of a relative humidity of 60% or less at 23° C. and a wind velocity of 1 m/s or less.

The electrophotographic photosensitive member generally includes a support and a photosensitive layer disposed on the support. Furthermore, in many cases, a conductive layer or an undercoat layer is disposed between the support and the photosensitive layer, or the photosensitive layer may be a multilayer type where a charge-generating layer and a charge-transporting layer (hole-transporting layer) are laminated. Furthermore, a technique of using the undercoat layer between the support and the photosensitive layer as a charge-transporting layer (electron-transporting layer) by imparting a charge-transporting ability (electron-transporting ability) to the layer is known. The undercoat layer is also called an intermediate layer or a barrier layer.

In the case of using a charge-transporting layer according to the present invention as the undercoat layer (for example, FIG. 1), the thickness of the charge-transporting layer can be 0.1 to 20 μm, such as 0.3 to 5 μm. In FIG. 1, a reference numeral 101 denotes a support, a reference numeral 102 denotes a charge-transporting layer serving as the undercoat layer in the present invention, a reference numeral 103 denotes a charge-generating layer, a reference numeral 104 denotes a charge-transporting layer, and a reference numeral 105 denotes a photosensitive layer (laminate-type photosensitive layer).

Figure 2:
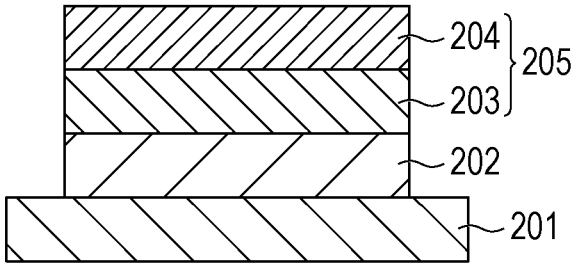
FIG. 2 is a diagram illustrating an example of the layer structure of an electrophotographic photosensitive member.

In the case of using a charge-transporting layer according to the present invention as the charge-transporting layer of a laminate-type photosensitive layer (for example, FIG. 2), the thickness of the charge-transporting layer can be 1 to 50 μm, such as 3 to 30 μm. In FIG. 2, a reference numeral 201 denotes a support, a reference numeral 202 denotes an undercoat layer, a reference numeral 203 denotes a charge-generating layer, a reference numeral 204 denotes a charge-transporting layer of the present invention, and a reference numeral 205 denotes a photosensitive layer (laminate-type photosensitive layer).

The temperature for heating a coating of the dispersion solution for charge-transporting layer according to the present invention can be 80 to 120° C. The polyolefin polymer particles can be sufficiently molten as long as the temperature is 80° C. or more, and shrinking of the coating film (charge-transporting layer) due to heating can be prevented as long as the temperature is 120° C. or less.

The support that is used in the electrophotographic photosensitive member may be any conductive substance (conductive support). Examples thereof include metal and alloy supports such as aluminum, aluminum alloy, nickel, copper, gold, iron, and stainless steel supports. In addition, the support may be those having a metal thin film, such as aluminum, silver, or gold film, or a conductive material film, such as indium oxide or tin oxide film, on an insulating support, such as a polyester, polycarbonate, polyimide, or glass support.

A conductive layer may be disposed between the support and the photosensitive layer in order to prevent interference fringes due to scattering of, for example, laser beams and to cover damages of the support.

The conductive layer can be formed by dispersing conductive particles such as carbon black particles, metal particles, or metal oxide particles in a binder resin. Examples of the metal oxide particles include particles of metal oxides such as zinc oxide and titanium oxide. As the conductive particles, barium sulfate particles covered with oxygen-deficiency-type tin oxide also can be used.

Examples of the binder resin that is used in the conductive layer include phenol polymers, polyurethane polymers, and polyamide polymers. These polymers have satisfactory adhesiveness to the support, well disperse the conductive particles, and exhibit excellent solvent resistance after formation of a layer.

The conductive layer may further contain a leveling agent for improving the surface flatness of the conductive layer.

An undercoat layer may be disposed between the support or the conductive layer and the photosensitive layer in order to, for example, improve the adhesiveness. A charge-transporting layer according to the present invention may be used as the undercoat layer.

In the case of providing an undercoat layer other than the charge-transporting layer according to the present invention, the undercoat layer can be formed by applying a coating liquid for undercoat layer prepared by dissolving a polymer in a solvent and drying the resulting coating.

Examples of the polymer that is used in the undercoat layer include casein, polyvinyl alcohol, nitrocellulose, polyamide (e.g., Nylon 6, Nylon 66, Nylon 610, copolymer nylon, and alkoxy methylated nylon), polyurethane, and aluminum oxide.

In the case of using a charge-transporting layer according to the present invention as the undercoat layer, the charge-transporting layer as the undercoat layer can be formed as described above, and the charge-transporting pigment particles can be electron-transporting pigment particles.

A photosensitive layer is disposed on the support, the conductive layer, or the undercoat layer.

The photosensitive layer may be a monolayer-type photosensitive layer containing a charge-generating material and a charge-transporting material in single layer or may be a laminate-type photosensitive layer where a charge-generating layer containing charge-generating material and a charge-transporting layer containing a charge-transporting material are laminated. From the viewpoint of electrophotographic characteristics, the laminate-type photosensitive layer, in particular, a laminate-type photosensitive layer where a charge-generating layer and a charge-transporting layer are laminated in this order from the support side (forward lamination-type photosensitive layer) can be used. In the forward lamination-type photosensitive layer, the charge-transporting layer can be a hole-transporting layer containing a hole-transporting material (hole-transporting compound) as the charge-transporting material.

As an example, the laminate-type photosensitive layer will be described below.

The charge-generating layer can be formed by applying a coating liquid for charge-generating layer prepared by dispersion treatment of a charge-generating material together with a binder resin and a solvent and dying the resulting coating.

Examples of the charge-generating material that is used in the present invention include azo pigments such as monoazo, disazo, and trisazo; phthalocyanine pigments such as metal phthalocyanine and non-metal phthalocyanine; indigo pigments such as indigo and thioindigo; perylene pigments such as perylene acid anhydride and perylene acid imide; polycyclic quinone pigments such as anthraquinone and pyrenequinone; squarilium coloring matters; pyrylium salts and thiapyrylium salts; triphenylmethane coloring matters; inorganic materials such as selenium, selenium-tellurium, amorphous silicon, cadmium surfide, and zinc oxide; quinacridone pigments; azlenium salt pigments; cyanine dyes; xanthene coloring matters; quinonimine coloring matters; and styryl coloring matters. Among these charge-generating materials, metal phthalocyanine pigments, in particular, oxytitanium phthalocyanine, chlorogallium phthalocyanine, dichlorotin phthalocyanine, and hydroxygallium phthalocyanine can be used. Above all, hydroxygallium phthalocyanine can be used.

Examples of the binder resin that is used in the charge-generating layer include butyral polymers, polyester polymers, polycarbonate polymers, polyarylate polymers, polystyrene polymers, polyvinyl methacrylate polymers, polyvinyl acrylate polymers, polyvinyl acetate polymers, polyvinyl chloride polymers, polyamide polymers, polyurethane polymers, silicone polymers, alkyd polymers, epoxy polymers, cellulose polymers, and melamine polymers. In particular, butyral polymers can be used.

The charge-transporting layer according to the present invention can be used as the charge-transporting layer of a laminate-type photosensitive layer and can be formed by the method described above. In the case of using a charge-transporting layer according to the present invention as the charge-transporting layer of the laminate-type photosensitive layer, the charge-transporting pigment particles can be hole-transporting pigment particles.

In the case of forming a charge-transporting layer other than the charge-transporting layer according to the present invention as the charge-transporting layer of the laminate-type photosensitive layer, the charge-transporting layer can be formed by applying a coating liquid for charge-transporting layer prepared by dissolving a charge-transporting material and a binder resin in a solvent and drying the resulting coating. The amount of the charge-transporting material can be 20 to 100 parts by mass, such as 30 to 100 parts by mass, based on 100 parts by mass of the total mass of the charge-transporting material and the binder resin.

Examples of the charge-transporting material that is used in the charge-transporting layer include polymer compounds having heterocyclic rings or condensed polycyclic aromatic groups such as poly-N-vinylcarbazole and polystyryl anthracene; heterocyclic compounds such as pyrazoline, imidazole, oxazole, triazole, and carbazole; triarylalkane derivatives such as triphenylmethane; triarylamine derivatives such as triphenylamine; and low-molecular-weight compounds such as phenylenediamine derivatives, N-phenylcarbazole derivatives, stilbene derivatives, and hydrazone derivatives.

Examples of the binder resin that is used in the charge-transporting layer include polycarbonate polymers, polyarylate polymers, and polyester polymers.

A surface protective layer may be disposed on the charge-transporting layer.

EXAMPLES

The present invention will be specifically described through examples below, but the present invention is not limited thereto. The term "part(s)" in the examples means "part(s) by mass".

In the examples, commercially available polymers (trade name: BONDINE HX-8290, BONDINE HX-8210, and BONDINE AX-8390, manufactured by Sumitomo Chemical Co., Ltd., and trade name: Primacor 5980I, manufactured by The Dow Chemical Company) and polymers B1 to B7 synthesized by the present inventors were used as polyolefin polymers.

Polymers B1 to B7 can be synthesized by a method described in, for example, the chapters 1 to 4 of New Polymer Experiment 2 Synthesis and Reaction of Polymer (1) (Kyoritsu Shuppan Co., Ltd.), Japanese Patent Laid-Open No. 2003-105145, or Japanese Patent Laid-Open No. 2003-147028. Measurement of compositions of polyolefin polymers Compositions of the polyolefin polymers were measured by the methods shown below. The results are shown in Table 1.

TABLE 1

| | A1 | | A2 | | A3 | |
|---|---|---|---|---|---|---|
| | Repeating structural unit | Composition ratio [mass %] | Repeating structural unit | Composition ratio [mass %] | Repeating structural unit | Composition ratio [mass %] |
| BONDINE HX-8290 | 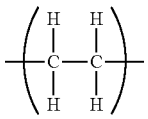 | 80.00 | 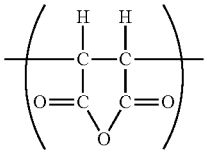 | 2.00 | 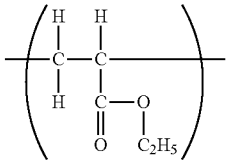 | 18.00 |
| BONDINE HX-8210 | ditto | 91.00 | ditto | 3.00 | ditto | 6.00 |
| BONDINE AX-8390 | ditto | 68.00 | ditto | 2.00 | ditto | 30.00 |
| Primacor 59801 | ditto | 80.00 | 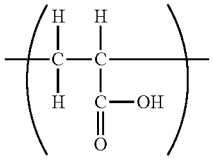 | 20.00 | — | 0.00 |
| Polymer (B1) | ditto | 85.00 | 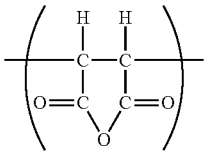 | 3.00 | 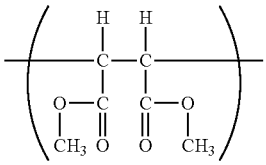 | 12.00 |
| Polymer (B2) | ditto | 85.00 | ditto | 8.00 | 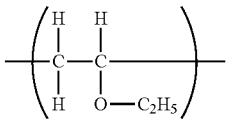 | 7.00 |
| Polymer (B3) | ditto | 92.00 | ditto | 5.00 | 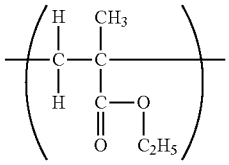 | 3.00 |
| Polymer (B4) | ditto | 60.00 | ditto | 30.00 | ditto | 10.00 |
| Polymer (B5) | 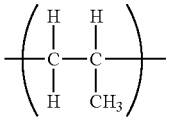 | 47.00 | 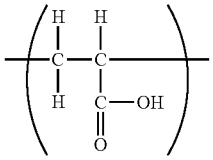 | 15.00 | ditto | 38.00 |

TABLE 1-continued

| | A1 | | A2 | | A3 | |
|---|---|---|---|---|---|---|
| | Repeating structural unit | Composition ratio [mass %] | Repeating structural unit | Composition ratio [mass %] | Repeating structural unit | Composition ratio [mass %] |
| Polymer (B6) | 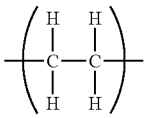 | 85.00 | 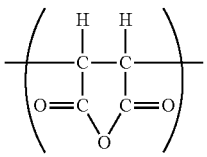 | 0.10 | 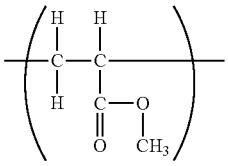 | 14.90 |
| Polymer (B7) | ditto | 85.00 | ditto | 0.01 | ditto | 14.99 |

(1) Composition Ratio of Carboxylic Acid Unit (A2) in Polyolefin Polymer

The acid value of each polyolefin polymer was measured in accordance with JIS K5407, and the composition ratio (graft rate) of the carboxylic acid unit (A2) was determined based on the value obtained by the following expression:

Composition ratio [mass %]=(mass of grafted carboxylic acid unit (*A2*))/(mass of polyolefin polymer)×100

(2) Composition Ratio of Polymer Other than Carboxylic Acid Unit (A2)

The composition ratios of polymers other than carboxylic acid unit (A2) were determined by $^{1}$H-NMR and $^{13}$C-NMR analyses (manufactured by Varian Inc., 300 MHz) in orthodichlorobenzene (d4) at 120° C. In the $^{13}$C-NMR analysis, the measurement was performed by a gate-decoupling method considering the quantitativity.

Preparation Example 1 of Polyolefin Polymer Particle Dispersion Solution

As a disperser, an agitator having a sealable pressure-resistant 1-liter glass container equipped with a heater was used. In this glass container, 75.0 g of BONDINE HX-8290 (polyolefin polymer), 60.0 of isopropanol, 5.1 g of triethylamine, and 159.9 g of distilled water were loaded and stirred at a rotational speed of the impeller of 300 rpm. As a result, no precipitation of the polymer particular substance was confirmed on the bottom of the container, and a floating state of the polymer was confirmed. This state was maintained for 10 minutes, and then the heater was turned on to heat the mixture. Stirring was continued for another 20 minutes while maintaining the system temperature at 140 to 145° C. Then, the container was put in a water bath and was cooled to room temperature (25° C.) while continuing the stirring at a rotational speed of 300 rpm. After that, pressure filtration (air pressure: 0.2 MPa) with a 300-mesh stainless steel filter (wire diameter: 0.035 mm, plain weave) was performed to obtain a uniform milky white polyolefin polymer particle dispersion (1).

Preparation Example 2 of Polyolefin Polymer Particle Dispersion Solution

A polyolefin polymer particle dispersion solution (2) was obtained in the same manner as in Preparation Example 1 of polyolefin polymer particle dispersion solution except that BONDINE HX-8210 was used instead of BONDINE HX-8290 as the polyolefin polymer.

Preparation Example 3 of Polyolefin Polymer Particle Dispersion Solution

As a disperser, an agitator having a sealable pressure-resistant 1-liter glass container provided with a heater was used. In this glass container, 60.0 g of BONDINE AX-8390 (polyolefin polymer), 100.0 g of n-propanol, 2.5 g of triethylamine, and 137.5 g of distilled water were loaded and stirred at a rotational speed of the impeller of 300 rpm. As a result, no precipitation of the polymer particular substance was confirmed on the bottom of the container, and a floating state of the polymer was confirmed. This state was maintained for 10 minutes, and then the heater was turned on to heat the mixture. Stirring was continued for another 20 minutes while maintaining the system temperature at 120° C. Then, the container was cooled to room temperature (25° C.) by air cooling while continuing the stirring at a rotational speed of 300 rpm. After that, pressure filtration (air pressure: 0.2 MPa) with a 300-mesh stainless steel filter (wire diameter: 0.035 mm, plain weave) was performed to obtain a uniform polyolefin polymer particle dispersion solution (3).

Preparation Example 4 of Polyolefin Polymer Particle Dispersion Solution

As a disperser, an agitator having a sealable pressure-resistant 1-liter glass container equipped with a heater was used. In this glass container, 60.0 g of Primacor 5980I (polyolefin polymer), 16.8 g of triethylamine, and 223.2 g of distilled water were loaded and stirred at a rotational speed of the impeller of 300 rpm. As a result, no precipitation of the polymer particular substance was confirmed on the bottom of the container, and a floating state of the polymer was confirmed. This state was maintained for 10 minutes, and then the heater was turned on to heat the mixture. Stirring was continued for another 30 minutes while maintaining the system temperature at 130° C. Then, the container was cooled to room temperature (25° C.) by air cooling while continuing the stirring at a rotational speed of 300 rpm. After that, pressure filtration (air pressure: 0.2 MPa) with a 300-mesh stainless steel filter (wire diameter: 0.035 mm, plain weave) was performed to obtain a polyolefin polymer particle dispersion solution (4).

Preparation Examples 5 to 11 of Polyolefin Polymer Particle Dispersion Solutions Polyolefin polymer particle dispersion solutions (5) to (11) were obtained in the same manner as in Preparation Example 1 of polyolefin polymer particle dispersion solution except that polymers (B1) to (B7) were used instead of BONDINE HX-8290 as the polyolefin polymers.

Formation Example 1 of Charge-Transporting Layer

A dispersion medium (dispersion medium mixture) composed of water/isopropanol=8/2 (mass ratio) was added to 40 parts of a charge-transporting pigment particles (E116) and 100 parts of polyolefin polymer particle dispersion solution (1) in such a manner that the solid content (polyolefin polymer particles and charge-transporting pigment particles) in the resulting mixture was 10 mass %. This solution mixture was subjected to dispersion treatment in a sand mill using glass beads having a diameter of 1 mm for 12 hours to obtain dispersion solution (1) for charge-transporting layer.

The particles composed of the polyolefin polymer particles and the charge-transporting pigment particles contained in the resulting dispersion solution (1) for charge-transporting layer had a number average particle diameter of 120 nm and a degree of dispersion (standard deviation/number average particle diameter) of 0.6.

The dispersion solution (1) for charge-transporting layer was applied onto an aluminum sheet by dipping, and the resulting coating was dried at 100° C. for 30 minutes to obtain a charge-transporting layer having a thickness of 1.0 μm.

The dispersion state of the charge-transporting pigment particles in the charge-transporting layer was evaluated by observing a cross-section of the charge-transporting layer using a transmission electron microscope (TEM) based upon the following criteria:

A: charge-transporting pigment particles were uniformly dispersed;

B: charge-transporting pigment particles were almost uniformly dispersed, but aggregation of about 2 to 5 charge-transporting pigment particles occurred at several positions, C: aggregation of about 2 to 5 charge-transporting pigment particles occurred in all over the cross-section, and D: aggregation of 5 or more charge-transporting pigment particles occurred in all over the cross-section.

One determined as criterion C or D was decided as that the effects of the present invention were not sufficiently achieved.

The dispersion state of the charge-transporting pigment particles in a dispersion solution for charge-transporting layer was evaluated by comparing the appearances of the dispersion solution for charge-transporting layer after the preparation and after storage for three months in a dark place at room temperature (25° C.), based upon the following criteria:

A: precipitation and phase separation were not observed at all in the appearance of a dispersion solution for charge-transporting layer, B: low concentration portions of the solid contents (polyolefin polymer particles and charge-transporting pigment particles) in a dispersion solution for charge-transporting layer were observed in the appearance, and C: precipitation and phase separation were apparently observed in the appearance of a dispersion solution for charge-transporting layer.

One determined as criterion C was decided as that the effects of the present invention were not sufficiently achieved. The results are shown in Table 2.

Formation Examples 2 to 10 and 28 to 50 of Charge-Transporting Layers

Charge-transporting layers were formed in the same manner as in Formation Example 1 of charge-transporting layer except that charge-transporting pigment particles shown in Tables 2 and 3 were used instead of the charge-transporting pigment particles (E116) in Formation Example 1, and the layers were evaluated. The results are shown in Tables 2 and 3.

Formation Examples 11 to 20 of Charge-Transporting Layers

Charge-transporting layers were formed in the same manner as in Formation Example 1 of charge-transporting layer except that polyolefin polymer particle dispersion solutions (2) to (11) were used instead of the polyolefin polymer particle dispersion solution (1) in Formation Example 1, and the layers were evaluated. The results are shown in Table 2.

Formation Examples 21 to 24 of Charge-Transporting Layers

Charge-transporting layers were formed in the same manner as in Formation Example 1 of charge-transporting layer except that a dispersion medium composed of water/isopropanol=10/0 (mass ratio) (i.e., water), a dispersion medium (medium mixture) composed of water/isopropanol=9/1 (mass ratio), a dispersion medium (medium mixture) composed of water/isopropanol=6/4 (mass ratio), or a dispersion medium (medium mixture) composed of water/isopropanol=5/5 (mass ratio) was used instead of the dispersion medium composed of water/isopropanol=8/2 (mass ratio) in Formation Example 1, and the layers were evaluated. The results are shown in Table 2.

Formation Examples 25 to 27 of Charge-Transporting Layers

Charge-transporting layers were formed in the same manner as in Formation Example 24 of charge-transporting layer except that the dispersion medium (medium mixture) composed of water/isopropanol=5/5 (mass ratio) was added in such a manner that the solid content (polyolefin polymer particles and charge-transporting pigment particles) in the resulting mixture was 7 mass %, 15 mass %, or 20 mass %, and the layers were evaluated. The results are shown in Table 2.

Formation Example C1 of Charge-Transporting Layer

A solution mixture was prepared by adding a dispersion medium (medium mixture) composed of water/isopropanol=3/7 (mass ratio) to 40 parts of charge-transporting pigment particles (E116) and 100 parts of polyolefin polymer particle dispersion solution (1) in such a manner that the solid content (polyolefin polymer particles and charge-transporting pigment particles) in the resulting mixture was 2 mass %. This solution mixture was subjected to dispersion treatment in a sand mill using glass beads having a diameter of 1 mm for 2 hours to obtain dispersion solution (C1) for charge-transporting layer.

The resulting dispersion solution (C1) for charge-transporting layer was applied to an aluminum sheet, and the resulting coating was dried at 100° C. for 30 minutes to obtain a charge-transporting layer having a thickness of 1.0 p.m.

The resulting charge-transporting layer was evaluated as in Formation Example 1 of charge-transporting layer. The results are shown in Table 3.

Formation Examples C2 and C3 of Charge-Transporting Layers

Charge-transporting layers were formed in the same manner as in Formation Example C1 of charge-transporting layer except that the dispersion medium (medium mixture) composed of water/isopropanol=3/7 (mass ratio) was added in such a manner that the solid content (polyolefin polymer particles and charge-transporting pigment particles) in the resulting mixture was 6 mass % or 30 mass %, and the layers were evaluated. The results are shown in Table 3.

Formation Example C4 of Charge-Transporting Layer

A polymer solution was prepared by dissolving 10 parts of N-methoxy methylated 6 nylon in 90 parts of methanol. To this polymer solution, 10 parts of charge-transporting pigment particles (E116) and 90 parts of methanol were added, and the resulting mixture was subjected to dispersion treatment in a sand mill using glass beads having a diameter of 1 mm for 2 hours to obtain dispersion solution (C4) for charge-transporting layer.

The resulting dispersion solution (C4) for charge-transporting layer was applied to an aluminum sheet, and the resulting coating was dried at 100° C. for 30 minutes to obtain a charge-transporting layer having a thickness of 1.0 μm.

The resulting charge-transporting layer was evaluated as in Formation Example 1 of charge-transporting layer. The results are shown in Table 3. The appearance of the dispersion solution for charge-transporting layer was observed to confirm that the N-methoxy methylated 6 nylon was completely dissolved not to have particle shapes.

Formation Example C5 of Charge-Transporting Layer

A polymer solution was prepared by dissolving 10 parts of a polyvinyl butyral polymer in 80 parts of butanol. To this polymer solution, 10 parts of charge-transporting pigment particles (E116) and 90 parts of methanol were added, and the resulting mixture was subjected to dispersion treatment in a sand mill using glass beads having a diameter of 1 mm for 2 hours to obtain dispersion solution (C5) for charge-transporting layer.

The resulting dispersion solution (C5) for charge-transporting layer was applied to an aluminum sheet, and the resulting coating was dried at 100° C. for 30 minutes to obtain a charge-transporting layer having a thickness of 1.0 μm.

The resulting charge-transporting layer was evaluated as in Formation Example 1 of charge-transporting layer. The results are shown in Table 3. The appearance of the dispersion solution for charge-transporting layer was observed to confirm that the polyvinyl butyral polymer was completely dissolved not to have particle shapes.

TABLE 2

| | Polyolefin polymer particles | Charge-transporting pigment particles | Number average particle diameter [nm] | Dispersity | Water fraction [mass %] | Solid fraction [mass %] | Solution stability: Initial | Solution stability: After long storage period | Dispersion state of charge-transporting pigment particles in charge-transporting layer |
|---|---|---|---|---|---|---|---|---|---|
| Charge-transporting layer formation example 1 | BONDINE HX-8290 | (E116) | 110 | 0.6 | 80 | 10 | A | A | A |
| Charge-transporting layer formation example 2 | BONDINE HX-8290 | (E106) | 200 | 0.4 | 80 | 10 | A | A | A |
| Charge-transporting layer formation example 3 | BONDINE HX-8290 | (E406) | 200 | 0.4 | 80 | 10 | A | A | A |
| Charge-transporting layer formation example 4 | BONDINE HX-8290 | (E502) | 160 | 0.6 | 80 | 10 | A | A | A |
| Charge-transporting layer formation example 5 | BONDINE HX-8290 | (E611) | 130 | 0.8 | 80 | 10 | A | A | A |
| Charge-transporting layer formation example 6 | BONDINE HX-8290 | (E710) | 100 | 1 | 80 | 10 | A | A | A |
| Charge-transporting layer formation example 7 | BONDINE HX-8290 | (E104) | 290 | 1 | 80 | 10 | A | A | B |
| Charge-transporting layer formation example 8 | BONDINE HX-8290 | (E801) | 300 | 0.9 | 80 | 10 | A | A | B |
| Charge-transporting layer formation example 9 | BONDINE HX-8290 | (E901) | 230 | 0.9 | 80 | 10 | A | A | B |
| Charge-transporting layer formation example 10 | BONDINE HX-8290 | (E118) | 260 | 0.8 | 80 | 10 | A | A | B |
| Charge-transporting layer formation example 11 | BONDINE HX-8210 | (E116) | 190 | 0.7 | 80 | 10 | A | A | A |
| Charge-transporting layer formation example 12 | BONDINE AX-8390 | (E116) | 230 | 0.8 | 80 | 10 | A | A | A |
| Charge-transporting layer formation example 13 | Primacor 5980I | (E116) | 180 | 0.4 | 80 | 10 | A | B | A |
| Charge-transporting layer formation example 14 | Polymer (B1) | (E116) | 160 | 0.8 | 80 | 10 | A | A | A |

TABLE 2-continued

| | Polyolefin polymer particles | Charge-transporting pigment particles | Number average particle diameter [nm] | Dispersity | Water fraction [mass %] | Solid fraction [mass %] | Solution stability: Initial | Solution stability: After long storage period | Dispersion state of charge-transporting pigment particles in charge-transporting layer |
|---|---|---|---|---|---|---|---|---|---|
| Charge-transporting layer formation example 15 | Polymer (B2) | (E116) | 170 | 0.9 | 80 | 10 | A | A | A |
| Charge-transporting layer formation example 16 | Polymer (B3) | (E116) | 180 | 0.3 | 80 | 10 | A | A | A |
| Charge-transporting layer formation example 17 | Polymer (B4) | (E116) | 200 | 0.5 | 80 | 10 | A | A | A |
| Charge-transporting layer formation example 18 | Polymer (B5) | (E116) | 210 | 0.8 | 80 | 10 | A | A | A |
| Charge-transporting layer formation example 19 | Polymer (B6) | (E116) | 230 | 0.8 | 80 | 10 | A | B | A |
| Charge-transporting layer formation example 20 | Polymer (B7) | (E116) | 220 | 0.8 | 80 | 10 | A | B | A |
| Charge-transporting layer formation example 21 | BONDINE HX-8290 | (E116) | 50 | 0.5 | 90 | 10 | A | A | A |
| Charge-transporting layer formation example 22 | BONDINE HX-8290 | (E116) | 80 | 0.5 | 100 | 10 | A | A | A |
| Charge-transporting layer formation example 23 | BONDINE HX-8290 | (E116) | 160 | 0.6 | 60 | 10 | A | A | A |
| Charge-transporting layer formation example 24 | BONDINE HX-8290 | (E116) | 210 | 0.9 | 50 | 10 | A | A | A |
| Charge-transporting layer formation example 25 | BONDINE HX-8290 | (E116) | 260 | 0.8 | 50 | 7 | A | B | A |
| Charge-transporting layer formation example 26 | BONDINE HX-8290 | (E116) | 230 | 0.6 | 50 | 15 | A | B | A |
| Charge-transporting layer formation example 27 | BONDINE HX-8290 | (E116) | 270 | 1 | 50 | 20 | A | B | A |

TABLE 3

| | Polyolefin polymer particles | Charge-transporting pigment particles | Number average particle diameter [nm] | Dispersity | Water fraction [mass %] | Solid fraction [mass %] | Solution stability: Initial | Solution stability: After long storage period | Dispersion state of charge-transporting pigment particles in charge-transporting layer |
|---|---|---|---|---|---|---|---|---|---|
| Charge-transporting layer formation example 28 | BONDINE HX-8290 | (E103) | 240 | 0.5 | 80 | 10 | A | A | B |
| Charge-transporting layer formation example 29 | BONDINE HX-8290 | (E112) | 150 | 0.6 | 80 | 10 | A | A | A |

TABLE 3-continued

| | Polyolefin polymer particles | Charge-transporting pigment particles | Number average particle diameter [nm] | Dispersity | Water fraction [mass %] | Solid fraction [mass %] | Solution stability | | Dispersion state of charge-transporting pigment particles in charge-transporting layer |
|---|---|---|---|---|---|---|---|---|---|
| | | | | | | | Initial | After long storage period | |
| Charge-transporting layer formation example 30 | BONDINE HX-8290 | (E120) | 250 | 0.8 | 80 | 10 | A | A | B |
| Charge-transporting layer formation example 31 | BONDINE HX-8290 | (E204) | 150 | 0.5 | 80 | 10 | A | A | A |
| Charge-transporting layer formation example 32 | BONDINE HX-8290 | (E205) | 120 | 0.6 | 80 | 10 | A | A | A |
| Charge-transporting layer formation example 33 | BONDINE HX-8290 | (E210) | 260 | 0.7 | 80 | 10 | A | A | B |
| Charge-transporting layer formation example 34 | BONDINE HX-8290 | (E301) | 240 | 0.8 | 80 | 10 | A | A | B |
| Charge-transporting layer formation example 35 | BONDINE HX-8290 | (E302) | 180 | 0.4 | 80 | 10 | A | A | A |
| Charge-transporting layer formation example 36 | BONDINE HX-8290 | (E310) | 250 | 0.9 | 80 | 10 | A | A | B |
| Charge-transporting layer formation example 37 | BONDINE HX-8290 | (E403) | 250 | 0.9 | 80 | 10 | A | A | B |
| Charge-transporting layer formation example 38 | BONDINE HX-8290 | (E409) | 280 | 0.8 | 80 | 10 | A | A | B |
| Charge-transporting layer formation example 39 | BONDINE HX-8290 | (E504) | 200 | 0.4 | 80 | 10 | A | A | A |
| Charge-transporting layer formation example 40 | BONDINE HX-8290 | (E507) | 130 | 0.6 | 80 | 10 | A | A | A |
| Charge-transporting layer formation example 41 | BONDINE HX-8290 | (E604) | 290 | 1 | 80 | 10 | A | A | B |
| Charge-transporting layer formation example 42 | BONDINE HX-8290 | (E613) | 260 | 0.8 | 80 | 10 | A | A | B |
| Charge-transporting layer formation example 43 | BONDINE HX-8290 | (E616) | 250 | 0.9 | 80 | 10 | A | A | B |
| Charge-transporting layer formation example 44 | BONDINE HX-8290 | (E619) | 240 | 0.9 | 80 | 10 | A | A | B |
| Charge-transporting layer formation example 45 | BONDINE HX-8290 | (E702) | 190 | 0.6 | 80 | 10 | A | A | A |
| Charge-transporting layer formation example 46 | BONDINE HX-8290 | (E704) | 280 | 0.8 | 80 | 10 | A | A | B |
| Charge-transporting layer formation example 47 | BONDINE HX-8290 | (E803) | 250 | 0.9 | 80 | 10 | A | A | B |

TABLE 3-continued

| | Polyolefin polymer particles | Charge-transporting pigment particles | Number average particle diameter [nm] | Dispersity | Water fraction [mass %] | Solid fraction [mass %] | Solution stability Initial | Solution stability After long storage period | Dispersion state of charge-transporting pigment particles in charge-transporting layer |
|---|---|---|---|---|---|---|---|---|---|
| Charge-transporting layer formation example 48 | BONDINE HX-8290 | (E807) | 230 | 1 | 80 | 10 | A | A | B |
| Charge-transporting layer formation example 49 | BONDINE HX-8290 | (E905) | 260 | 0.8 | 80 | 10 | A | A | B |
| Charge-transporting layer formation example 50 | BONDINE HX-8290 | (E907) | 270 | 0.7 | 80 | 10 | A | A | B |
| Charge-transporting layer formation example C1 | BONDINE HX-8290 | (E116) | 350 | 1 | 30 | 2 | A | C | C |
| Charge-transporting layer formation example C2 | BONDINE HX-8290 | (E116) | 280 | 3.5 | 30 | 6 | A | C | C |
| Charge-transporting layer formation example C3 | BONDINE HX-8290 | (E116) | 330 | 2.5 | 30 | 30 | A | C | C |
| Charge-transporting layer formation example C4 | — | (E116) | — | — | — | — | B | C | D |
| Charge-transporting layer formation example C5 | — | (E116) | — | — | — | — | B | C | D |

In Tables 2 and 3, the term "water fraction [mass %]" means the amount of water (ratio) [mass %] in a dispersion solution based on the total mass of water and alcohol in the dispersion solution. The term "solid fraction [mass %]" means the sum (ratio) of the amount of polyolefin polymer particles and the amount of charge-transporting pigment particles in a dispersion solution based on the total mass of the dispersion solution.

Example 1

An aluminum cylinder having a diameter of 30 mm and a length of 260.5 mm was washed with ultrasonic water and was used as a support.

Then, 40 parts of barium sulfate particles covered by oxygen-deficiency-type tin oxide (powder resistivity: 200 Ω·cm, coverage of oxygen-deficiency-type tin oxide: 60 mass %), 8 parts of titanium oxide particles (trade name: TITANIX JR, manufactured by Tayca Corp.), 25 parts of a phenol polymer as a binder resin (trade name: Plyophen J-325, manufactured by DIC Corp., polymer solid content: 60 mass %), 30 parts of methoxypropanol, and 30 parts of methanol were mixed, and the resulting mixture was subjected to dispersion treatment in a sand mill using glass beads having a diameter of 1 mm for 2 hours. To the resulting dispersion solution, 3.9 parts of silicone polymer particles serving as a surface roughness-providing material (trade name: Tospearl 120, manufactured by GE Toshiba Silicone Co., Ltd., average particle diameter: 2 μm) and 0.002 parts of silicone oil as a leveling agent (trade name: SH28PA, manufactured by Toray Dow Corning Silicone Co., Ltd.) were added, followed by stirring to prepare a coating liquid for conductive layer. The coating liquid for conductive layer was applied to the support by dipping under an environment of 23° C./60% RH. The resulting coating was dried and thermally cured at 140° C. for 30 minutes to obtain a conductive layer having a thickness of 20 μm.

Then, the dispersion solution (1) for charge-transporting layer was applied onto the conductive layer by dipping, and the resulting coating was heated at 100° C. for 30 minutes to melt the polyolefin polymer particles and thereby form a charge-transporting layer (electron-transporting layer) as an undercoat layer having a thickness of 1.0 μm.

A mixture of 10 parts of hydroxygallium phthalocyanine crystals (charge-generating material) in a crystal form showing main peaks at Bragg angles, 2θ±0.2°, of 7.5°, 9.9°, 16.3°, 18.6°, 25.1°, and 28.3° in the CuKα characteristic X-ray diffraction, 5 parts of a polyvinyl butyral polymer (trade name: S-LEC BX-1, manufactured by Sekisui Chemical Co., Ltd.), 0.1 parts of a compound represented by the following Formula (15):

(15)

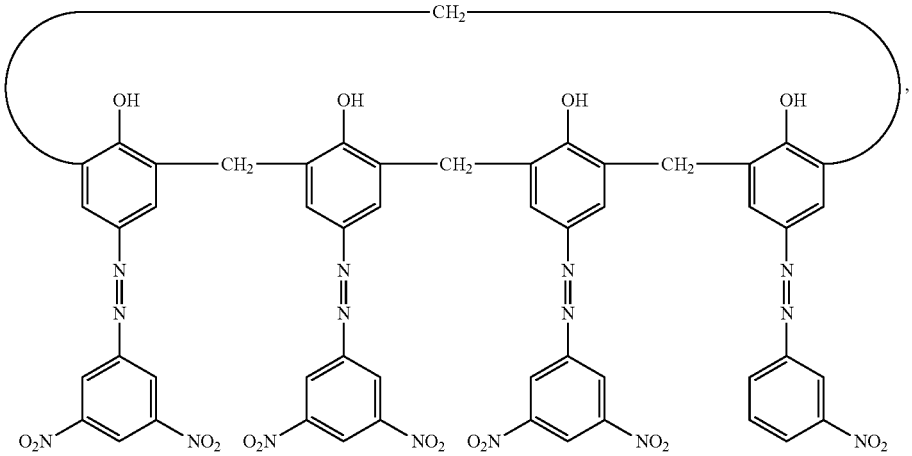

and 250 parts of cyclohexanone was subjected to dispersion treatment in a sand mill using glass beads having a diameter of 1 mm for 4 hours. The resulting dispersion solution was diluted with 250 parts of ethyl acetate to prepare a coating liquid for charge-generating layer. This coating liquid for charge-generating layer was applied onto the charge-transporting layer (electron-transporting layer) serving as an undercoat layer by dipping, and the resulting coating was dried at 100° C. for 10 minutes to form a charge-generating layer having a thickness of 0.16 μm.

A coating liquid for charge-transporting layer was prepared by dissolving 10 parts of a compound (charge-transporting material (hole-transporting compound)) represented by the following Formula (16):

(16)

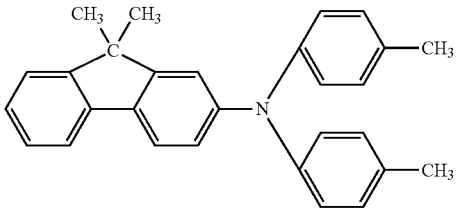

and 10 parts of a polyarylate polymer (weight average molecular weight Mw: 115000) having a repeating structural unit represented by the following Formula (17):

(17)

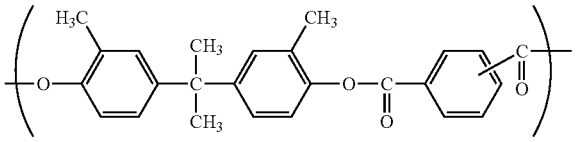

in a solvent mixture of 50 parts of monochlorobenzene and 30 parts of dichloromethane. This coating liquid for charge-transporting layer was applied onto the charge-generating layer by dipping, and the resulting coating was dried at 120° C. for 1 hour to obtain a charge-transporting layer (hole-transporting layer) having a thickness of 12 μm.

The thus-produced electrophotographic photosensitive member was left under an environment of an ordinary temperature and an ordinary humidity (23.5° C./50% RH) for 24 hours and was then evaluated for electrophotographic characteristics under the same environment.

The electrophotographic characteristics were evaluated as follows: First, the developing unit was detached from a laser beam printer (trade name: Laser Jet 4600, manufactured by Hewlett-Packard Company) modified so that the light intensity was variable, and instead a potential measuring probe was set at the position of the unit. In this state, the produced electrophotographic photosensitive member was set, and sensitivity (the quantity of light required for light attenuation to a light potential of −200 V when a dark potential was set at −700 V) and residual potential (the potential when irradiated with light in a quantity greater than five times the quantity of light according to the sensitivity) were measured. The results are shown in Table 4.

Examples 2 to 6

Electrophotographic photosensitive members were produced as in Example 1 except that dispersion solution (2), (7), (11), (23), or (26) for charge-transporting layer was used for forming a charge-transporting layer (electron-transporting layer) serving as the undercoat layer, instead of dispersion solution (1) for charge-transporting layer in Example 1, and the electrophotographic photosensitive members were evaluated. The results are shown in Table 4.

Example 7

The surface of an aluminum cylinder having a diameter of 30 mm and a length of 260.5 mm was subjected to honing treatment and then washed with ultrasonic water. This cylinder was used as a support.

Then, the dispersion solution (1) for charge-transporting layer was applied to the support by dipping, and the resulting coating was heated at 100° C. for 30 minutes to melt the polyolefin polymer particles and thereby obtain a charge-transporting layer (electron-transporting layer) having a thickness of 1.0 μm as the undercoat layer.

Then, as in Example 1, a charge-generating layer and a charge-transporting layer (hole-transporting layer) were formed on the charge-transporting layer (electron-transporting layer) serving as the undercoat layer to produce an electrophotographic photosensitive member.

The produced electrophotographic photosensitive member was evaluated as in Example 1. The results are shown in Table 4.

Reference Example 1

An electrophotographic photosensitive member was produced as in Example 1 except that an undercoat layer formed as shown below was used instead of the charge-transporting layer (electron-transporting layer) as the undercoat layer in Example 1 and was evaluated. The results are shown in Table 4.

Formation of Undercoat Layer

A coating liquid for undercoat layer was prepared by dissolving 5 parts of N-methoxy methylated 6 nylon in 95 parts of methanol. This coating liquid for undercoat layer was applied onto the conductive layer by dipping, and the resulting coating was dried at 100° C. for 30 minutes to form an undercoat layer having a thickness of 1.0 μm.

TABLE 4

| | Sensitivity [μJ · cm$^2$] | Residual potential [−V] |
|---|---|---|
| Example 1 | 0.21 | 18 |
| Example 2 | 0.22 | 17 |
| Example 3 | 0.22 | 16 |
| Example 4 | 0.23 | 19 |
| Example 5 | 0.23 | 20 |
| Example 6 | 0.23 | 23 |
| Example 7 | 0.23 | 18 |
| Reference Example 1 | 0.25 | 15 |

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2010-264129, filed Nov. 26, 2010 and No. 2011-206101, filed Sep. 21, 2011, which are hereby incorporated by reference herein in their entirety.

The invention claimed is:

1. A method of producing an electrophotographic photosensitive member comprising a charge-transporting layer, the method comprising a step of forming a coating film by applying a dispersion solution comprising polyolefin polymer particles and charge-transporting pigment particles as dispersoids and comprising a dispersion medium, and then forming the charge-transporting layer by heating the coating film and melting the polyolefin polymer particles, wherein, the particles consisting of the polyolefin polymer particles and the charge-transporting pigment particles in the dispersion solution have a number average particle diameter of 50 nm or more and 300 nm or less and a degree of dispersion (standard deviation/number average particle diameter) of 1.0 or less.

2. The method of producing an electrophotographic photosensitive member according to claim 1, wherein the dispersion solution comprises water and alcohol as the dispersion media, and the amount of the water in the dispersion solution is 50 mass % or more based on the total mass of the water and the alcohol in the dispersion solution.

3. The method of producing an electrophotographic photosensitive member according to claim 1, wherein the total amount of the polyolefin polymer particles and the charge-transporting pigment particles in the dispersion solution is 7 mass % or more and 20 mass % or less based on the total mass of the dispersion solution.

4. The method of producing an electrophotographic photosensitive member according to claim 1, wherein the charge-transporting pigment particles have alkyl groups.

5. The method of producing an electrophotographic photosensitive member according to claim 1, wherein the polyolefin polymer particles have the following (A1), (A2), and (A3) in a mass ratio satisfying the following expression:

$$0.01 \leq (A2)/\{(A1)+(A2)+(A3)\} \times 100 \leq 30, \text{ and}$$

$$55/45 \leq (A1)/(A3) \leq 99/1,$$

(A1) is a repeating structural unit represented by the following Formula (121):

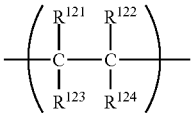

(121)

wherein, $R^{121}$ to $R^{124}$ each independently represents a hydrogen atom or an alkyl group;

(A2) is a repeating structural unit represented by the following Formula (131) or (132):

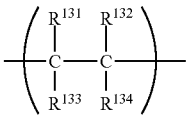

(131)

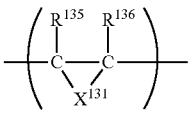

(132)

wherein, $R^{131}$ to $R^{134}$ each independently represents a hydrogen atom, an alkyl group, a phenyl group, or a monovalent group represented by —$Y^{131}$COOH ($Y^{131}$ represents a single bond, an alkylene group, or an arylene group), wherein at least one of $R^{131}$ to $R^{134}$ is a monovalent group represented by —$Y^{131}$COOH; $R^{135}$ and $R^{136}$ each independently represents a hydrogen atom, an alkyl group, a phenyl group; and $X^{131}$ represents a divalent group represented by —$Y^{132}$COOCO$Y^{133}$— ($Y^{132}$ and $Y^{133}$ each independently represents a single bond, an alkylene group, or an arylene group); and (A3) is a repeating structural unit represented by the following Formula (141), (142), (143), or (144):
(141)
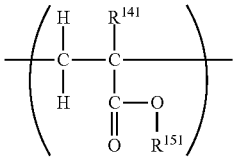
(142)
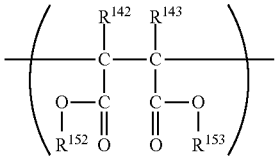
-continued
(143)
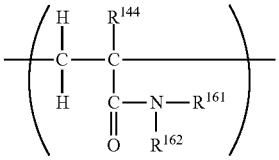
(144)
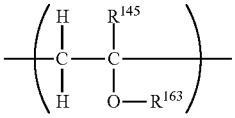
wherein, $R^{141}$ to $R^{145}$ each independently represents a hydrogen atom or a methyl group; $R^{151}$ to $R^{153}$ each independently represents an alkyl group having 1 to 10 carbon atoms; and $R^{161}$ to $R^{163}$ each independently represents a hydrogen atom or an alkyl group having 1 to 10 carbon atoms.
* * * * *